US008857948B2

(12) United States Patent
Suzuki et al.

(10) Patent No.: US 8,857,948 B2
(45) Date of Patent: Oct. 14, 2014

(54) LIQUID EJECTING APPARATUS, INSPECTION METHOD, AND PROGRAM

(71) Applicant: Seiko Epson Corporation, Tokyo (JP)

(72) Inventors: Toshiyuki Suzuki, Matsumoto (JP); Osamu Shinakawa, Chino (JP); Masahiko Yoshido, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/851,480

(22) Filed: Mar. 27, 2013

(65) Prior Publication Data

US 2013/0293610 A1 Nov. 7, 2013

(30) Foreign Application Priority Data

May 2, 2012 (JP) ..... 2012-105271

(51) Int. Cl.
*B41J 29/393* (2006.01)

(52) U.S. Cl.
USPC ..... 347/19; 347/9; 347/14

(58) Field of Classification Search
USPC ..... 347/5, 9, 10, 14, 19
See application file for complete search history.

(56) References Cited

U.S. PATENT DOCUMENTS

| | | | | |
|---|---|---|---|---|
| 7,341,325 | B2 * | 3/2008 | Shinkawa | 347/19 |
| 2002/0089562 | A1 * | 7/2002 | Simons et al. | 347/19 |
| 2005/0212845 | A1 | 9/2005 | Shinkawa | |

FOREIGN PATENT DOCUMENTS

| | | |
|---|---|---|
| JP | 2005-305992 | 11/2005 |

* cited by examiner

*Primary Examiner* — Lam S Nguyen
(74) *Attorney, Agent, or Firm* — Harness, Dickey & Pierce, P.L.C.

(57) ABSTRACT

A liquid ejecting apparatus includes a head having a first ejecting unit including a first liquid ejecting nozzle, a first pressure chamber communicating with the nozzle, and a first drive element, and a second ejecting unit including a second liquid ejecting nozzle, a second pressure chamber communicating with the nozzle, and a second drive element. The first nozzle ejects liquid by applying a drive signal to the first drive element, and the second nozzle ejects liquid by applying the drive signal to the second drive element. The first nozzle state is determined using a first detection signal obtained by applying a first drive signal to the first drive element and a second drive signal to the second drive element, and a second detection signal obtained by applying the first drive signal to the first drive element and a third drive signal to the second drive element.

8 Claims, 12 Drawing Sheets

| | | | |
|---|---|---|---|
| INDEPENDENT DRIVE | TESTED NOZZLE (#N) | ○ (ON) | |
| | ADJACENT NOZZLE (#N−1, #N+1) | × (OFF) | |
| SIMULTANEOUS DRIVE | TESTED NOZZLE (#N) | ○ (ON) | |
| | ADJACENT NOZZLE (#N−1, #N+1) | ○ (ON) | × (OFF) |

| | |
|---|---|
| TESTED NOZZLE (#N) | ○ (ON) |
| NON-TESTED NOZZLE (OTHER THAN #N) | × (OFF) |

| | | | |
|---|---|---|---|
| TESTED NOZZLE (#N) | | ○ (ON) | |
| NON-TESTED NOZZLE | ADJACENT NOZZLE (#N−1, #N+1) | ○ (ON) | × (OFF) |
| | NON-DRIVEN NOZZLE (OTHER THAN #N−1 TO #N+1) | × (OFF) | |

| | | | |
|---|---|---|---|
| INDEPENDENT DRIVE | TESTED NOZZLE (#N) | ○ (ON) | |
| | ADJACENT NOZZLE (#N−1, #N+1) | × (OFF) | |
| SIMULTANEOUS DRIVE | TESTED NOZZLE (#N) | ○ (ON) | |
| | ADJACENT NOZZLE (#N−1, #N+1) | ○ (ON) | × (OFF) |

FIG. 10

| | | TEST TARGET NOZZLE | ADJACENT NOZZLE |
|---|---|---|---|
| TEST METHOD 1 | FIRST DRIVE | EJECTION OR MINUTE VIBRATION (DEPRESSURIZATION +PRESSURIZATION) | NON-EJECTION, NON-MINUTE VIBRATION (CONSTANT) |
| | SECOND DRIVE | | EJECTION OR MINUTE VIBRATION (DEPRESSURIZATION +PRESSURIZATION) |
| TEST METHOD 2 | FIRST DRIVE | EJECTION | MINUTE VIBRATION |
| | SECOND DRIVE | | EJECTION |
| TEST METHOD 3 | FIRST DRIVE | PRESSURIZATION | DEPRESSURIZATION |
| | SECOND DRIVE | | PRESSURIZATION |
| TEST METHOD 4 | FIRST DRIVE | PRESSURIZATION | CONSTANT |
| | SECOND DRIVE | | PRESSURIZATION |
| TEST METHOD 5 | FIRST DRIVE | EJECTION OR MINUTE VIBRATION | DEPRESSURIZATION |
| | SECOND DRIVE | | EJECTION OR MINUTE VIBRATION |
| TEST METHOD 6 | FIRST DRIVE | DEPRESSURIZATION | PRESSURIZATION |
| | SECOND DRIVE | | DEPRESSURIZATION |

LIQUID EJECTING APPARATUS, INSPECTION METHOD, AND PROGRAM

BACKGROUND

1. Technical Field

The present invention relates to a liquid ejecting apparatus, an inspection method, and a program.

2. Related Art

As an example of a liquid ejecting apparatus, an ink jet printer (hereinafter, referred to as a printer) which ejects ink droplets from a nozzle provided in a head and forms an image is exemplified. Specifically, ink droplets are ejected from a nozzle in communication with a pressure chamber by a pressure change of the ink in the pressure chamber, which is caused when a drive element is driven. According to such a printer, there is a case where an ejection failure of the ink from the nozzle occurs due to an increase in viscosity of the ink within the nozzle due to evaporation of ink solvent from the nozzle or mixing in of air bubbles into the nozzle. Thus, a method for inspecting a nozzle, which causes an ejection failure, based on residual vibration after causing a pressure change in the ink in the pressure chamber by driving the drive element has been proposed (see JP-A-2005-305992, for example).

Generally, a head is configured by bonding a flow path formation substrate on which a pressure chamber is formed with a nozzle plate on which a nozzle is formed. For this reason, a part of the flow path formation substrate (a partition wall of the pressure chamber) peels off from the nozzle plate in some cases due to age-related degradation. If so, ink in a pressure chamber escapes to a next pressure chamber and an ejection failure occurs even if a drive element is driven and a volume in the pressure chamber is changed.

According to an inspection method in which residual vibration is detected by driving only a drive element corresponding to a nozzle as an inspection target as in the inspection method described in JP-A-2005-305992, residual vibration occurs in the same manner both in a case where the flow path formation substrate has peeled off from the nozzle plate and in a case where an ejection failure occurs due to an increase in viscosity of the ink. For this reason, it is determined that the ejection failure due to an increase in viscosity of the ink has occurred even in the case where the flow path formation substrate has peeled off from the nozzle plate, and head cleaning processing is unnecessarily performed.

SUMMARY

An advantage of some aspects of the invention is to allow inspection of malfunction of a head (peeling-off of a substrate and a nozzle plate).

According to an aspect of the invention, there is provided a liquid ejecting apparatus including: a head which is provided with a plurality of ejecting units including a first ejecting unit which includes a first nozzle for ejecting liquid, a first pressure chamber in communication with the nozzle, and a first drive element provided for the pressure chamber, and a second ejecting unit which includes a second nozzle for ejecting liquid, a second pressure chamber in communication with the nozzle, and a second drive element provided at the pressure chamber, wherein the first nozzle is caused to eject liquid by applying a drive signal to the first drive element, and the second nozzle is caused to eject liquid by applying the drive signal to the second drive element, and wherein a state of the first nozzle is determined using a first detection signal obtained by applying a first drive signal to the first drive element and applying a second drive signal to the second drive element, and a second detection signal obtained by applying the first drive signal to the first drive element and applying a third drive signal to the second drive element.

Other features of embodiments of the invention will be clarified by descriptions in the specification and accompanying drawings.

BRIEF DESCRIPTION OF THE DRAWINGS

The invention will be described with reference to the accompanying drawings, wherein like numbers reference like elements.

FIG. 10 is a table showing a modification example of first drive and second drive.

DESCRIPTION OF EXEMPLARY EMBODIMENTS

Overview of Disclosure

Figure 1:
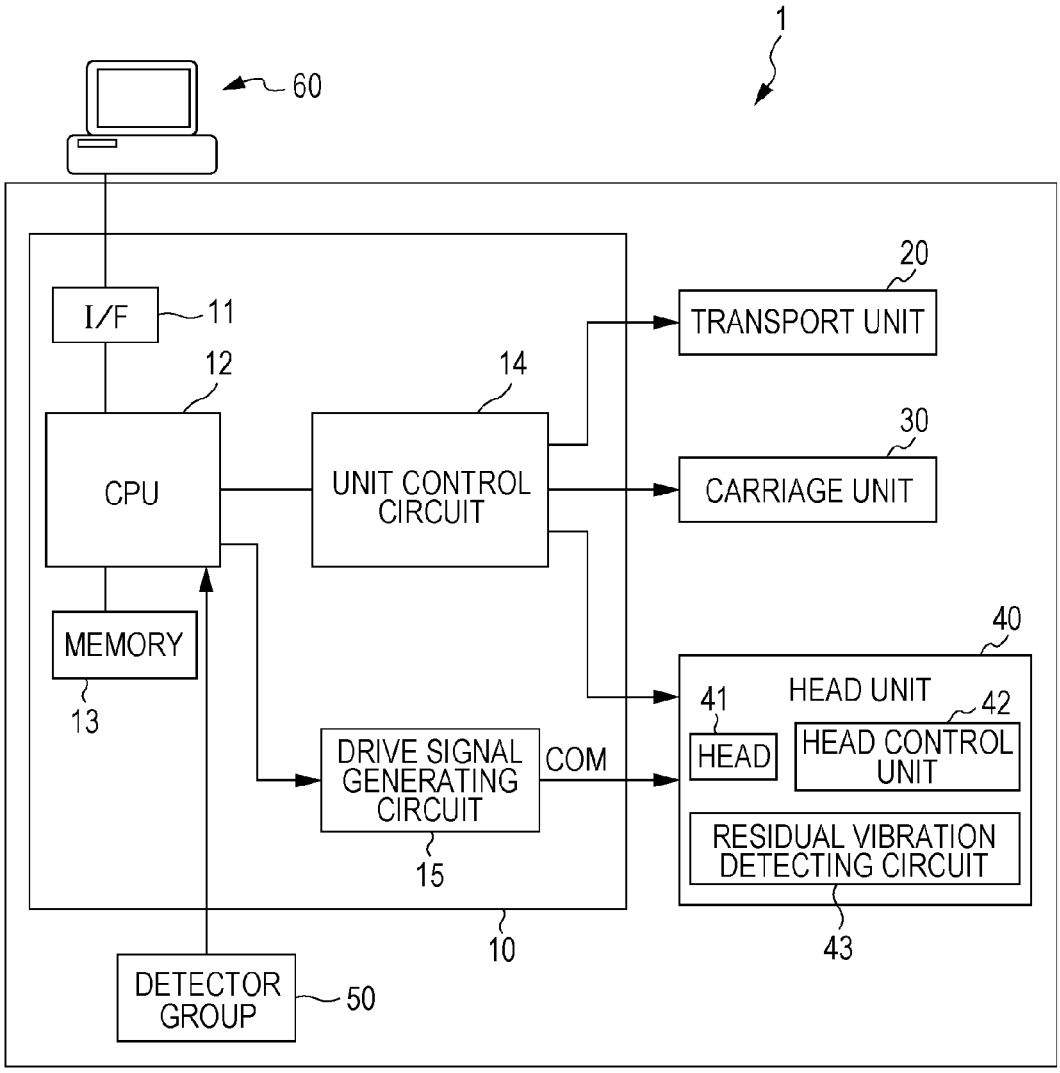
FIG. 1 is a block diagram showing an overall configuration of a print system.

At least the following can be clarified by the descriptions in the specification and the accompanying drawings.

That is, there is provided a liquid ejecting apparatus including: a head which includes a plurality of nozzles for ejecting liquid, pressure chambers provided for each of the nozzles in communication with the corresponding nozzles, and drive elements provided for each of the pressure chambers and a control section which causes a pressure change in the liquid in a pressure chamber corresponding to a drive element by applying a drive signal and driving the drive element and inspects the head based on a first detection signal obtained by driving the drive element corresponding to an inspection target nozzle by first drive and a second detection signal obtained by driving the drive element corresponding to the inspection target nozzle by second drive, wherein pressure changes in the pressure chambers of nozzles next to the inspection target nozzle are different in the first drive and the second drive.

In such a liquid ejecting apparatus, it is possible to detect a nozzle which causes an ejection failure due to mixing in of air bubbles and an increase in viscosity of the liquid (ink) and detect malfunction of the head (peeling-off of a partition wall of the pressure chamber from a nozzle plate).

According to such a liquid ejecting apparatus, the control section inspects whether or not the head recovers by cleaning processing for recovering from a liquid ejection failure of the nozzle based on the first detection signal and the second detection signal.

In such a liquid apparatus, it is possible to detect a nozzle which causes an ejection failure due to mixing in of air bubbles and an increase in viscosity of the liquid (ink) and inspect malfunction of the head (peeling-off of the partition wall of the pressure chamber from the nozzle plate).

According to such a liquid ejecting apparatus, adjacent nozzles are nozzles on both sides of the inspection target nozzle.

In such a liquid ejecting apparatus, it is possible to reliably pressurize the liquid in the pressure chamber even when the partition wall of the pressure chamber has peeled off. Therefore, it is possible to more precisely distinguish a malfunction nozzle whose partition wall of the pressure chamber has peeled off from an increased viscosity nozzle in which viscosity of the liquid (ink) has increased.

According to such a liquid ejecting apparatus, the control section inspects the head based on the first detection signal and the second detection signal obtained by sequentially performing the first drive and the second drive on the same nozzle.

In such a liquid ejecting apparatus, it is possible to more precisely distinguish a malfunction nozzle whose partition wall of the pressure chamber has peeled off from an increased viscosity nozzle in which viscosity of the liquid (ink) has increased.

According to such a liquid ejecting apparatus, the control section detects a failure nozzle which causes a liquid ejection failure based on a detection signal obtained by performing the first drive on the plurality of nozzles in order, then sets the detected failure nozzle as the inspection target nozzle, obtains the first detection signal and the second detection signal, and inspects the head.

In such a liquid ejecting apparatus, it is possible to facilitate control by the control section and minimize the inspection time of the head.

According to such a liquid ejecting apparatus, the control section firstly sets a failure nozzle positioned at the center of a plurality of failure nozzles sequentially aligned in a predetermined direction as a failure nozzle when the plurality of nozzles sequentially aligned in the predetermined direction are detected as failure nozzles.

In such a liquid ejecting apparatus, it is possible to minimize the inspection time of the head.

According to such a liquid ejecting apparatus, the control section does not eject the liquid from the adjacent nozzles in the first drive and ejects the liquid from the adjacent nozzles in the second drive.

In such a liquid ejecting apparatus, it is possible to differentiate the pressure changes in the pressure chambers of the nozzles next to the inspection target nozzle in the first drive and the second drive.

There is also provided an inspection method of a head which includes a plurality of nozzles for ejecting liquid, pressure chambers provided for each of the nozzles in communication with the corresponding nozzles, and drive elements provided for each of the pressure chambers, the method including: obtaining a first detection signal by driving a drive element corresponding to an inspection target nozzle in first drive; obtaining a second detection signal by driving the drive element corresponding to the inspection target nozzle in second drive; and inspecting the head based on the first detection signal and the second detection signal, wherein the pressure changes in the pressure chambers of the nozzles next to the inspection target nozzle are different in the first drive and the second drive.

In such an inspection method, it is possible to detect a nozzle which causes an ejection failure due to mixing in of air bubbles and an increase in viscosity of the liquid (ink) and inspect malfunction of the head (peeling-off of the partition wall of the pressure chamber from the nozzle plate).

There is also provided a program for causing a computer to inspect a head which includes a plurality of nozzles for ejecting liquid, pressure chambers provided for each of the nozzles in communication with the corresponding nozzles, and drive elements provided for each of the pressure chambers, the program causing the computer to implement functions of: obtaining a first detection signal by driving a drive element corresponding to an inspection target nozzle in first drive; obtaining a second detection signal by driving the drive element corresponding to the inspection target nozzle in second drive; and inspecting the head based on the first detection signal and the second detection signal, wherein the pressure changes in the pressure chambers of the nozzles next to the inspection target nozzle are different in the first drive and the second drive.

According to such a program, it is possible to detect a nozzle which causes an ejection failure due to mixing in of air bubbles and an increase in viscosity of the liquid (ink) and inspect malfunction of the head (peeling-off of the partition wall of the pressure chamber from the nozzle plate).

Print System

An ink jet printer (hereinafter, referred to as a printer) is exemplified as a "liquid apparatus", and a description will be given of embodiments based on an example of a print system to which a printer and a computer are connected.

Figure 2A:
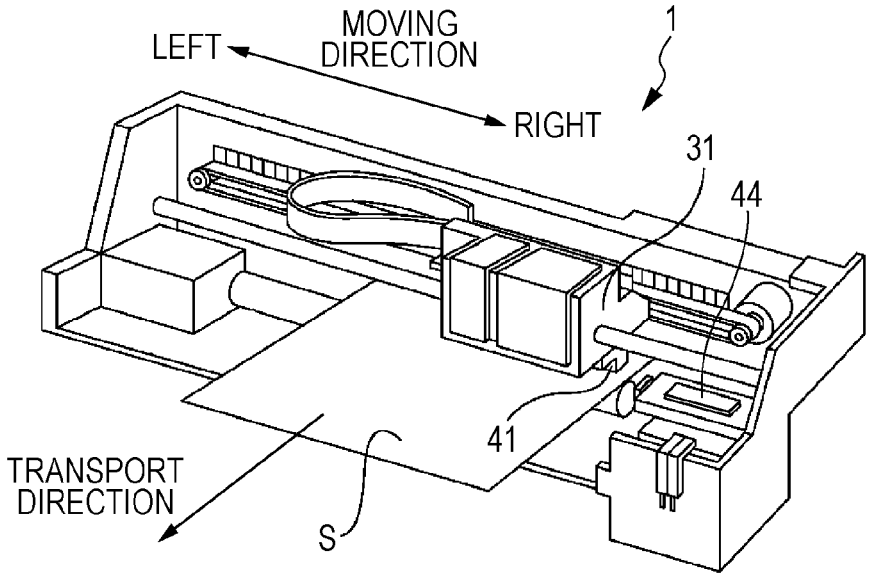
FIG. 2A is an outline perspective view of a printer.
Figure 2B:
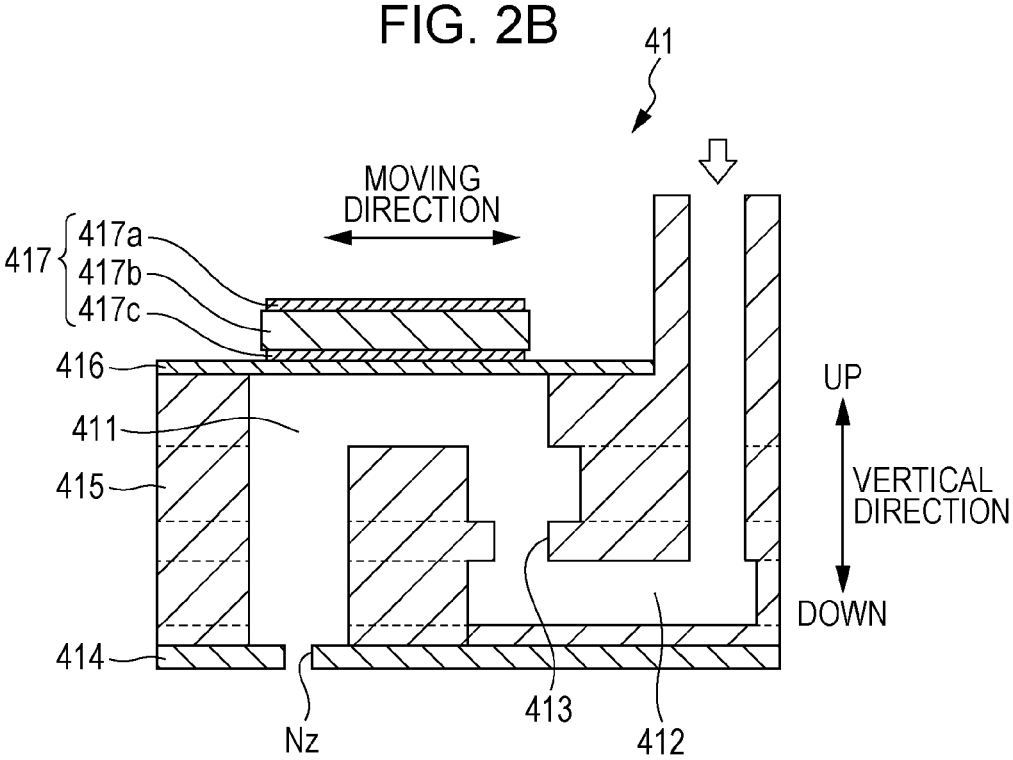
FIG. 2B is a cross-sectional view of (a part of) a head when viewed in a medium transport direction.

FIG. 1 is a block diagram showing an overall configuration of the print system. FIG. 2A is an outline perspective view of a printer 1, and FIG. 2B is a cross-sectional view of (a part of) a head 41 viewed in a transport direction of a medium S.

The printer 1 includes a controller 10, a transport unit 20, a carriage unit 30, a head unit 40, and a detector group 50. The printer 1 is connected to a computer 60 so as to be able to communicate with the computer 60, and a printer driver installed in the computer 60 uses hardware resources in the computer 60 to create print data for causing the printer 1 to print an image or output the print data to the printer 1.

The controller 10 in the printer 1 is for performing overall control in the printer 1. An interface unit 11 exchanges data with the computer 60 as an external apparatus. A CPU 12 is a computation processing apparatus for performing overall control of the printer 1 and controls the respective units via a unit control circuit 14. A memory 13 is for securing an area for storing a program of the CPU 12, a work area, and the like. The detector group 50 is for monitoring a condition in the printer 1 and outputting the detection signal thereof to the controller 10.

The transport unit 20 is for supplying a medium S such as a sheet, a cloth, or a film to a position where printing can be performed and transporting the medium S in the transport direction, The carriage unit 30 is for moving the head 41 mounted on the carriage 31 in a direction which intersects the transport direction of the medium S (a perpendicular direction, in general).

The head unit 40 includes the head 41 which ejects ink to the medium S, a head control section 42, a residual vibration detecting circuit 43, and a cap 44. As shown in FIG. 2B, multiple nozzles Nz which eject ink droplets, pressure chambers 411, each of which is provided for each nozzle Nz in communication with the corresponding nozzle Nz, common ink chambers 412, each of which is provided for each ink color, to which ink from ink cartridges is supplied, and an ink supply port 413 which connects the plurality of pressure chambers 411 filled with ink with the same color and the common ink chamber 412 are formed as an ink flow path in the head 41.

In the lower surface of the head 41, multiple nozzles Nz of each ink color are aligned in the transport direction at predetermined intervals to form a nozzle array. Generally, a black nozzle array for ejecting black ink, a cyan nozzle array for ejecting cyan ink, a magenta nozzle array for ejecting magenta ink, a yellow nozzle array for ejecting yellow ink, and the like are formed.

In the head 41, a nozzle plate 414 in which the nozzles Nz are formed is bonded to the lower surface of the flow path formation substrate 415 on which the pressure chamber 411, the common ink chamber 412, and the like are formed, a vibrating plate 416 is bonded to the upper surface of the flow path formation substrate 415, and the vibrating plate 416 configures a ceiling portion of the pressure chamber 411. In addition, a drive element 417 is attached to the upper surface of the vibrating plate 416 for each pressure chamber 411 (for each nozzle Nz). Although the drive element 417 shown in FIG. 2B is configured by pinching a piezoelectric element 417*b* by two electrodes 417*a* and 417*c*, the configuration is not limited thereto, and a laminated piezoelectric actuator may be applied to the drive element.

In addition, the controller 10 (control section) applies a drive signal COM generated by a drive signal generating circuit 15 to the drive element 417 and changes a flexure amount of the drive element 417 in the vertical direction in accordance with potential of the drive signal COM. As a result, the vibrating plate 416 is displaced in the vertical direction, a volume of the pressure chamber 411 varies (expands and contracts), and ink droplets are ejected from the nozzle Nz in communication with the pressure chamber 411.

The head control section 42 is for controlling a drive of the head 41 and selectively applies the drive signal COM to the drive element 417 in accordance with print data. The residual vibration detecting circuit 43 is for detecting residual vibration after causing a pressure change in the ink within the pressure chamber 411 by driving the drive element 417 (as will be described later in detail).

The cap 44 is arranged at a position, which is a home position (in a non-printing area at an end on the right side in the moving direction), at which the cap 44 can face the lower surface of the head 41 moving in the moving direction. The cap 44 suppresses evaporation of the ink solvent from the nozzle Nz by receiving ink droplets ejected from the nozzle Nz during cleaning of the head 41 and being brought into close contact with the lower surface of the head 41 to seal the nozzle Nz.

In the printer 1 configured as described above, the controller 10 alternately repeats an ejecting operation for causing nozzles to eject ink droplets while moving the head 41 in the moving direction via the carriage 31 and a transport operation for transporting the medium S in the transport direction via the transport unit 20. As a result, a dot is formed by a later ejecting operation at a different position from a position of a dot which is formed by a previous ejecting operation, and therefore, a two-dimensional image is printed on the medium S.

Drive of Head 41

Figure 3A:
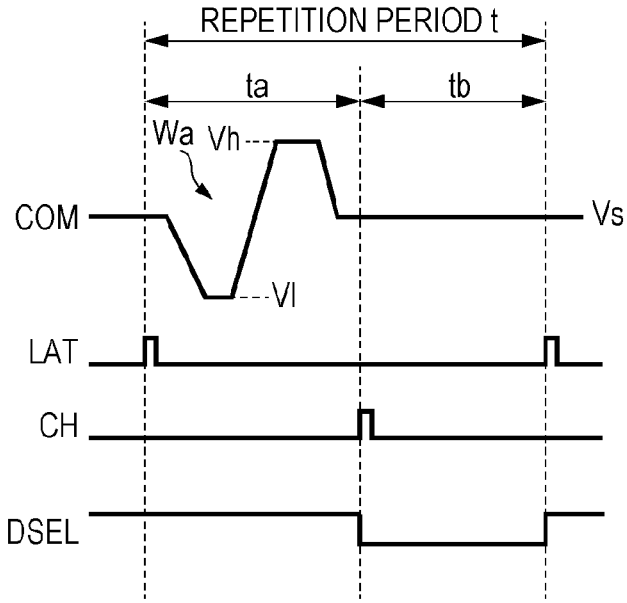
FIG. 3A is a diagram illustrating a drive signal, and 3B is a diagram illustrating a head control section.
Figure 3B:
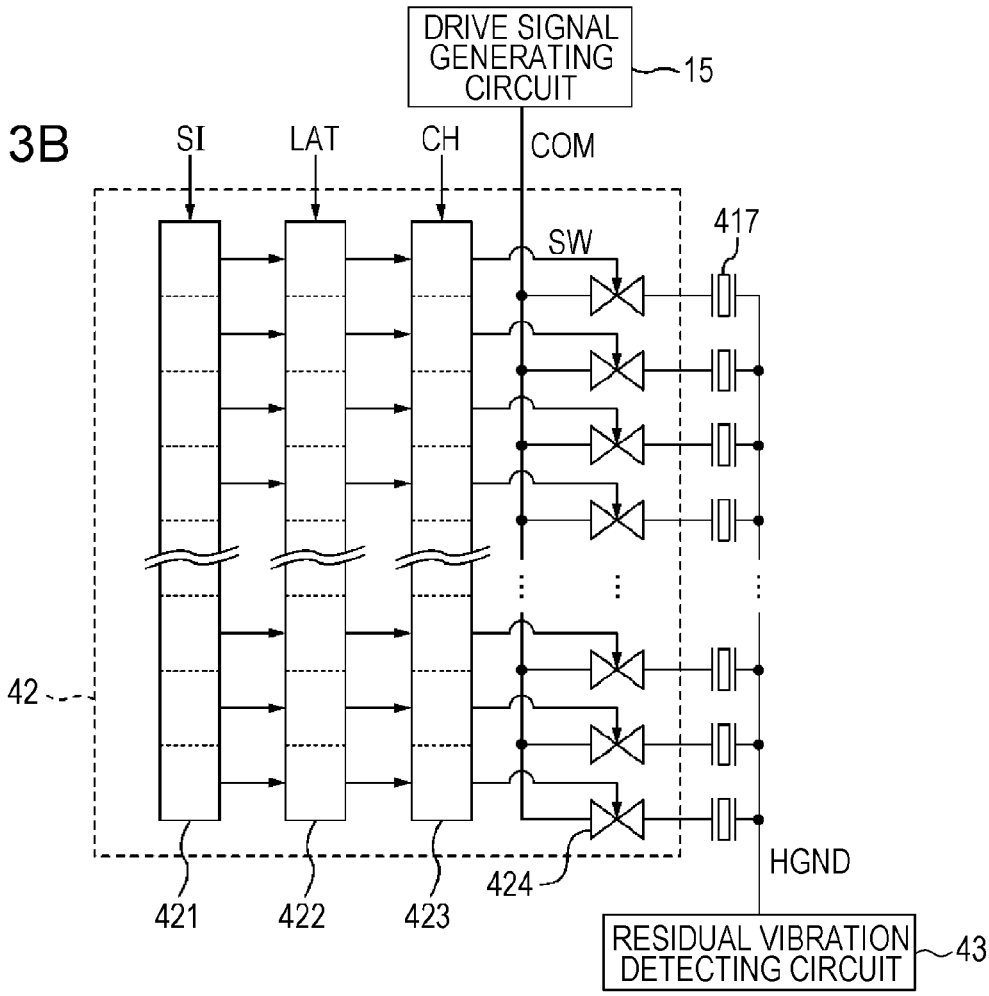

FIG. 3A is a diagram illustrating the drive signal COM for driving the drive element 417, and FIG. 3B is a diagram illustrating the head control section 42. In this embodiment, it is assumed that each nozzle Nz forms a dot with one size of one pixel on the medium S (a unit area where one dot is formed) and which is expressed by two tone levels. A period during which the nozzle Nz faces one pixel on the medium S is referred to as a "repetition cycle t" and the repetition cycle t is defined by a rising pulse of a latch signal LAT. Then, an ejection waveform Wa is generated in the drive signal COM during a drive period to of the repetition cycle t, and standby potential Vs is maintained during an inspection period tb.

The ejection waveform Wa is a waveform for causing the nozzle Nz to eject an ink droplet. More specifically, the pressure chamber 411 expands due to a waveform part which lowers the potential from the standby potential Vs to minimum potential Vl, and pressure of the ink in the pressure chamber 411 falls. Thereafter, the pressure chamber 411 contracts due to a waveform part which raises the potential from the minimum potential Vl to maximum potential Vh, the pressure of the ink in the pressure chamber 411 increases, and an ink droplet is ejected from the nozzle Nz. Finally, the volume of the pressure chamber 411 returns to the original volume due to a waveform part which lowers the potential from the maximum potential Vh to the standby potential Vs.

The head control section 42 includes a shift register 421, a latch circuit 422, a level shifter 423, and a switch 424 for each drive element 417 (for each nozzle Nz) as shown in FIG. 3B. Hereinafter, a description will be given of a flow until the drive signal COM is applied to the drive element 417 by the head control section 42.

First, pixel data SI (print data) in a certain repetition cycle t is serial-transferred from the controller 10 to the head control section 42. Here, the pixel data SI is data [1] indicating that a dot is to be formed at a pixel in some cases and data [0] indicating that a dot is not to be formed at a pixel in other cases. Then, the pixel data SI allocated to each drive element 417 is maintained by the shift register 421 corresponding to the drive element 417.

Then, the latch circuit 422 maintains the pixel data SI stored on the shift register 421 based on the latch signal LAT and outputs a logical signal in accordance with the pixel data SI to the level shifter 423. The level shifter 423 outputs a switch control signal SW for controlling ON and OFF operations of the switch 424 based on the logical signal output from the latch circuit 422 and a shift signal CH. Here, a rising pulse occurs in the shift signal CH at a timing at which the periods to and tb in the repetition cycle t are shifted. Accordingly, the level shifter 423 shifts content of the switch control signal SW at a timing at which the rising pulse of the shift signal CH occurs. In addition, terminals of a plurality of switches 24 on one end sides are commonly connected, and a common drive signal COM generated by the drive signal generating circuit 15 is input to each switch 424.

In addition, terminals of the respective switches 424 on the other end sides are respectively connected to the terminals of the corresponding drive element 417 on the one end sides, and the electrodes of the drive elements 417 on the other end sides are commonly connected (ground terminal HGND) to the residual vibration detecting circuit 43. Accordingly, the drive signal COM is applied to the drive elements 417 during a period in which the switches 424 are turned on (connected), and the drive signal COM is not applied to the drive elements 417 during a period in which the switches 424 are turned off (not connected).

For example, the pixel data SI[1] indicating that a dot is to be formed at a pixel is allocated, the switches 424 are turned on during the drive period ta in the repetition cycle t, the drive signal COM is applied to the drive elements 417 during the drive period ta, and therefore, ink droplets are ejected from the nozzles Nz by the ejection waveform Wa. On the other hand, when the pixel data SI[0] indicating that a dot is not to be formed at a pixel is allocated, the switches 424 are turned off during the drive period ta, the drive signal COM is not applied to the drive elements 417 during the drive period ta, and therefore, ink droplets are not ejected from the nozzles Nz. As described above, ejection of the ink droplets from the respective nozzles Nz is controlled in accordance with the pixel data SI.

Ejection Failure Nozzle and Cleaning Processing

Ejection Failure Nozzle

There is a case where ink droplets are not ejected over a relatively long period from a nozzle Nz which is used with low frequency in printing, the ink solvent evaporates from the nozzle Nz during the period, viscosity of the ink within the nozzle Nz and the pressure chamber 411 increases, and the nozzle Nz clogs. Then, an ejection failure such as non-ejection of a prescribed amount of ink from the nozzle Nz or deviation of a flying direction of the ink droplet ejected from the nozzle Nz occurs.

In addition, there is a case where air bubbles are mixed into the pressure chamber 411. In such a case, it is not possible to appropriately pressurize the ink in the pressure chamber 411 even if the drive signal COM is applied to the drive element 417 to expand or contract the pressure chamber 411, and an ejection failure occurs. If an image is printed by using such a nozzle which causes an ejection failure due to the ink with increased viscosity or mixing in of air bubbles, quality of the printed image deteriorates.

Cleaning Processing

Thus, when an ejection failure nozzle occurs due to the ink with increased viscosity or mixing in of air bubbles in the printer 1, cleaning processing of the head 41 is performed in order that ink droplets are ejected normally from the ejection failure nozzle. The printer 1 according to this embodiment performs flushing processing and pump suctioning processing as the cleaning processing for the head 41.

The flushing processing is processing in which the head 41 is moved to the home position and the nozzle Nz is forced to eject ink droplets toward the cap 44. Specifically, the ejection waveform Wa shown in FIG. 3A is continuously applied to the drive element 417. In doing so, the ink with increased viscosity and air bubbles is discharged from the nozzle Nz, and the ejection failure nozzle can recover to a normal nozzle.

The pump suctioning processing is processing in which the cap 44 and the head 41 are brought into close contact with each other so as to surround the nozzle Nz by a concave portion formed in the upper surface of the cap 44 and the air in a tightly closed space formed between the concave portion of the cap 44 and the nozzle surface of the head 41 is suctioned by a pump. In doing so, pressure in the tightly closed space becomes negative pressure, the ink with increased viscosity and air bubbles is discharged from the nozzle Nz, and the ejection failure nozzle can recover to a normal nozzle.

Residual Vibration Detecting Circuit 43

Figure 4A:
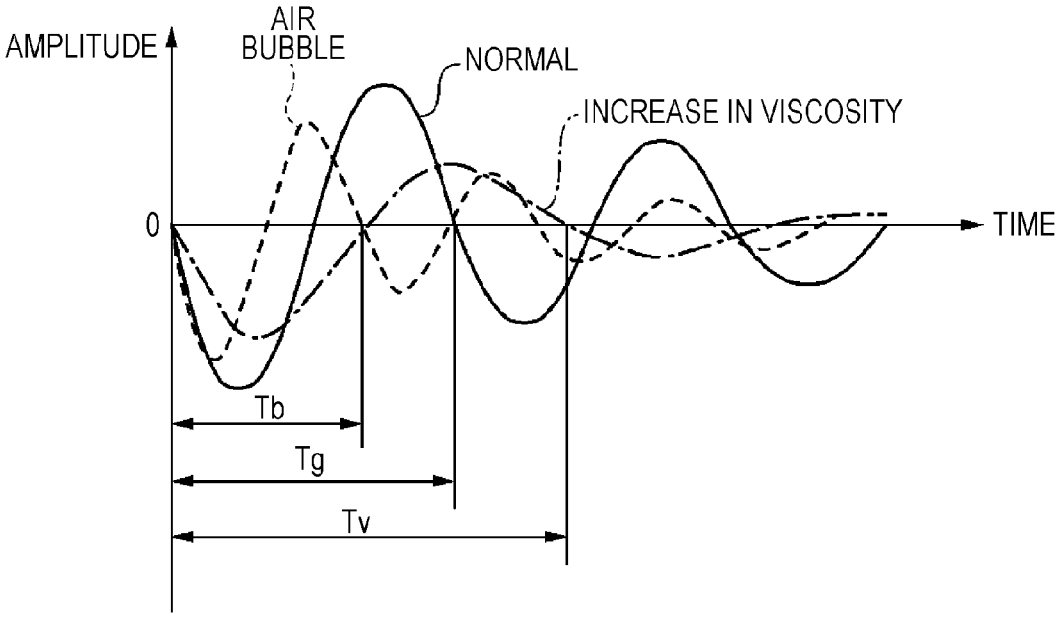
FIG. 4A is a diagram showing an example of residual vibration.
Figure 4B:
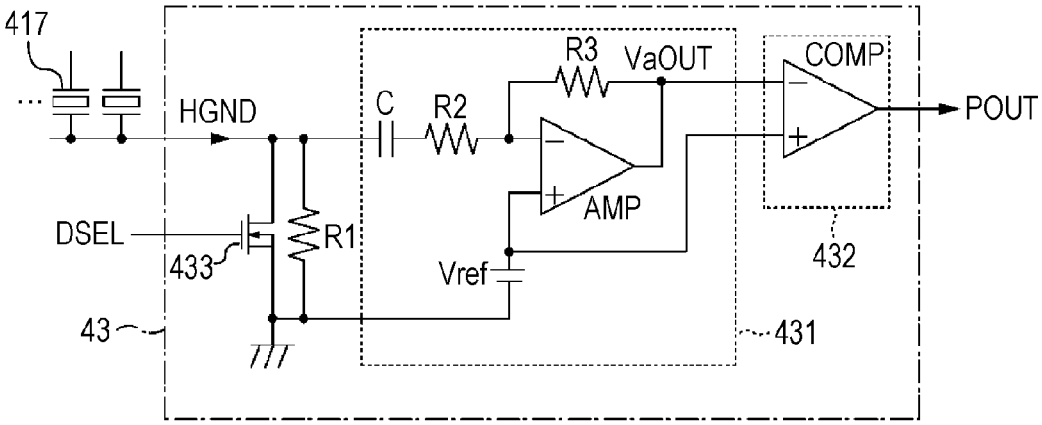
FIG. 4B is an explanatory diagram of a residual vibration detecting circuit.

FIG. 4A is a diagram showing an example of residual vibration after causing a pressure change in the ink within the pressure chamber 411 by driving the drive element 417, and FIG. 4B is an explanatory diagram of the residual vibration detecting circuit 43 which detects residual vibration. In the graph shown in FIG. 4A, the vertical axis represents amplitude of the residual vibration, and the horizontal axis represents time. In addition, FIG. 4A shows residual vibration in a case where the ink droplets are ejected normally from the nozzle Nz (normal), residual vibration (air bubble) in a case where air bubbles are mixed into the nozzle Nz and the pressure chamber 411, and residual vibration (increased viscosity) in a case where viscosity of the ink in the nozzle Nz and the pressure chamber 411 increases.

If the drive signal COM (ejection waveform Wa) is applied to the drive element 417 to drive the drive element 417, and a pressure change is generated in the ink in the pressure chamber 411 corresponding to the drive element 417, residual vibration (free vibration) then occurs in the ink in the pressure chamber 411 and the vibrating plate 416. It is possible to know a state in the nozzle Nz and the pressure chamber 411 depending on how the residual vibration occurs.

If a step response when pressure P is applied to a single vibration calculation model on the assumption of residual vibration of the vibrating plate 416 is calculated in terms of a volume velocity u, the following Equations (1) to (3) can be obtained.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

In addition, a flow path resistance r is determined based on shapes of flow paths such as the ink supply port 413, the pressure chamber 411, and the nozzle Nz and viscosity of the ink in the flow paths. Inertance m is determined based on weights of ink in the flow paths such as the ink supply port 413, the pressure chamber 411, and the nozzle Nz. Compliance C is determined based on flexibility of the vibrating plate 416.

If air bubbles are mixed into the pressure chamber 411 and the nozzle Nz, the ink weight (inertance m) decreases by the weight of the mixed in air bubbles, and therefore, an angular velocity ω increases as shown in Equation (2), and a vibration cycle is shortened (a vibration frequency increases). Accordingly, a cycle Tb of the residual vibration when the air bubbles are mixed in is shorter than a cycle Tg of the residual vibration at the normal time (Tb<Tg) as shown in FIG. 4A.

On the other hand, since the flow path resistance r increases when the ink in the pressure chamber 411 and the nozzle Nz dries and the viscosity thereof increases, the amplitude decreases (an attenuation rate increases). In addition, the angular velocity ω decreases, and the frequency cycle extends (a vibration frequency decreases) as shown by Equations (2) and (3). Accordingly, a cycle Tv of the residual vibration when the viscosity increases is longer than the cycle Tg of the residual vibration at the normal time as shown in FIG. 4A (Tv>Tg).

As described above, it is possible to know a state in the nozzle Nz and the pressure chamber 411 based on the cycle of the residual vibration. Thus, in the printer 1 according to this embodiment, the residual vibration detecting circuit 43 detects residual vibration after a pressure change is caused in the ink in the pressure chamber 411 by driving the drive element 417, and the controller 10 specifies an ejection failure nozzle and a cause of the ejection failure (mixing in of air bubbles and an increase in viscosity of the ink) based on the detection signal (the cycle of the residual vibration).

By detecting not only the ejection failure nozzle but also the cause of the ejection failure, it is possible to perform processing in accordance with the cause of the ejection failure. For example, it is necessary to perform the pump suctioning processing which consumes a large amount of ink in order to recover the ejection failure nozzle due to mixing in of the air bubbles. On the other hand, the ejection failure nozzle due to the ink with increased viscosity can recover by the flushing processing which consumes a small amount of ink. In such a case, it is possible to suppress unnecessary ink consumption by performing processing in accordance with the cause of the ejection failure.

The residual vibration detecting circuit 43 (FIG. 4B) detects mechanical deviation of the piezoelectric element 417*b* (the drive element 417) by the residual vibration of the vibrating plate 416 as a change of open circuit voltage of the piezoelectric element 417*b*.

As shown in FIG. 3B, the residual vibration detecting circuit 43 is commonly provided for a plurality of drive elements 417, and electrodes of the respective drive elements 417 on the ground side are commonly connected (ground terminal HGND) to the residual vibration detecting circuit 43.

In addition, the residual vibration detecting circuit 43 includes a switch 433 (N-channel MOSFET) which grounds or opens the ground terminal HGND of the drive element 417, a resistance R1 which is electrically connected to the switch 433 in parallel, an AC amplifier 431 which amplifies an AC component of the open circuit voltage of the drive element 417 (piezoelectric element 417*b*), a comparator 432 which compares output voltage VaOUT from the AC amplifier 431 with a reference voltage Vref. Among the components, the AC amplifier 431 is configured by a capacitor C which removes a DC component and a computing device AMP which performs invert amplification at a gain determined by resistances R2 and R3 on the basis of the reference voltage Vref.

For example, when residual vibration of a certain inspection nozzle is detected, the switch 424 in the head controller section 42 (FIG. 3B) corresponding to the inspection nozzle is turned on during the drive period to in the repetition cycle t. In addition, a gate signal DSEL is switched to an H level, and the switch 433 in the residual vibration detecting circuit 43 is turned on. In doing so, the ground terminal HGND of the drive element 417 is brought into a grounded state, and the drive signal COM (ejection waveform Wa) is applied to the drive element 417 corresponding to the inspection nozzle, and a pressure change occurs in the ink in the pressure chamber 411 corresponding to the inspection nozzle.

Thereafter, the voltage of the drive signal COM is maintained to be constant (Vs) during the inspection period tb in the repetition cycle t, and only the switch 424 in the head control section 42 corresponding to the inspection nozzle is turned on.

In addition, the gate signal DSEL is switched to an L level, the switch 433 in the residual vibration detecting circuit 43 is turned off, and the ground terminal HGND of the drive element 417 is disconnected from the ground. In doing so, the open circuit voltage (the open circuit voltage in accordance with the residual vibration) of the drive element 417 corresponding to the inspection nozzle is extracted by the residual vibration detecting circuit 43.

The open circuit voltage of the drive element 417 is amplified (VaOUT) by the AC amplifier 431, then input to the comparator 432, and compared with the reference voltage Vref. When the reference voltage Vref is higher than the open circuit voltage VaOUT of the drive element 417, a pulse signal POUT in the H level is output. When the reference voltage Vref is lower than the open circuit voltage VaOUT of the drive element 417, the pulse signal POUT in the L level is output. Accordingly, the pulse signal POUT is a signal in accordance with a change in the open circuit voltage of the drive element 417, namely a signal in accordance with the residual vibration of the inspection nozzle. The controller 10 obtains the pulse signal POUT from the residual vibration detecting circuit 43, obtains a cycle of the pulse signal POUT as a cycle of the residual vibration of the inspection nozzle, and determines a state in the inspection nozzle and the pressure chamber 411.

Hereinafter, a description will be given of a method for inspecting the head 41 by the controller 10 (the control section, a computer) following a program for inspecting the head 41, which is stored on the memory 13, for example, based on a detection signal (pulse signal POUT) output from the residual vibration detecting circuit 43.

First Embodiment

Method for Inspecting Head 41

According to a first embodiment, the head 41 is inspected by performing "single drive inspection" for inspecting the residual vibration by driving only the drive element 417 corresponding to the nozzle Nz as an inspection target and then performing "simultaneous drive inspection" for inspecting the residual vibration by driving elements 417 corresponding to the nozzle Nz as the inspection target and adjacent nozzles Nz. In addition, it is assumed that the head 41 is inspected when printing is stopped (for example, before printing is started) in the first embodiment.

Single Drive Inspection

Figure 5A:
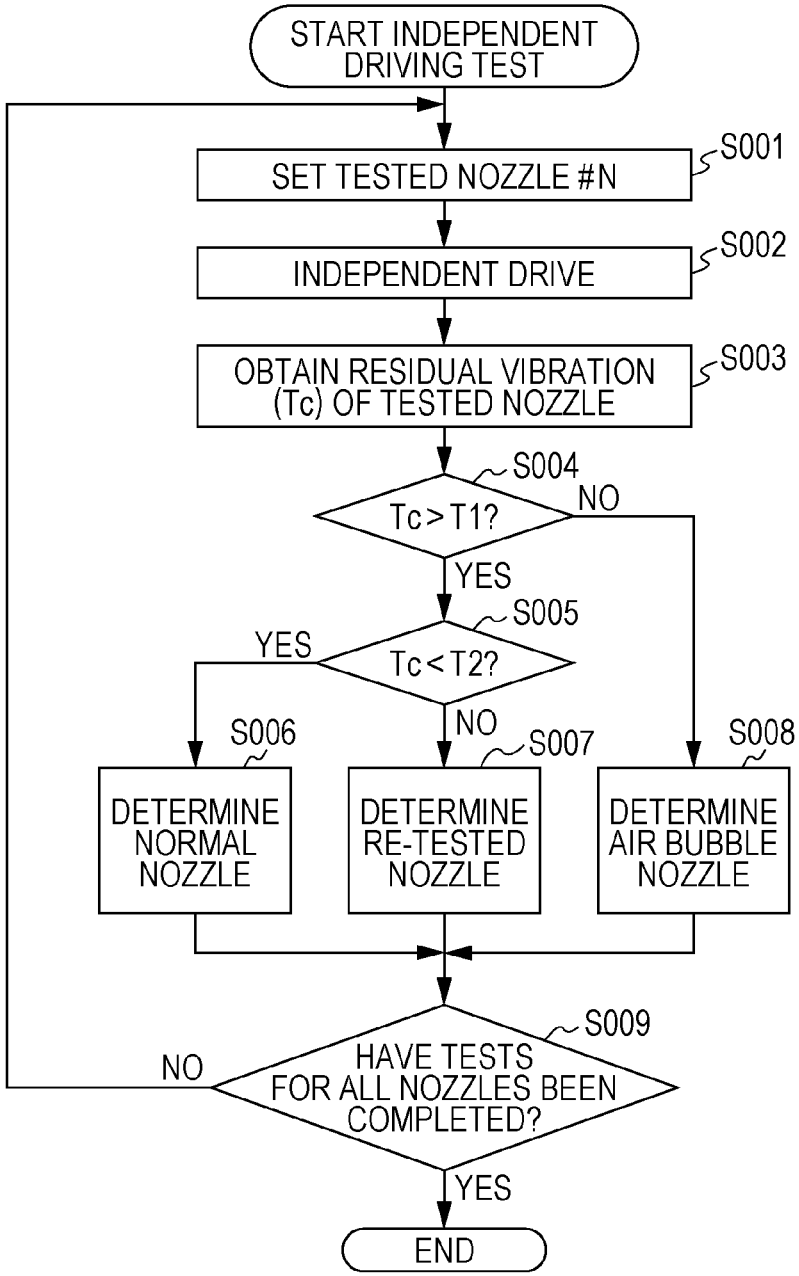
FIG. 5A shows a flow of single drive inspection.
Figure 5B:
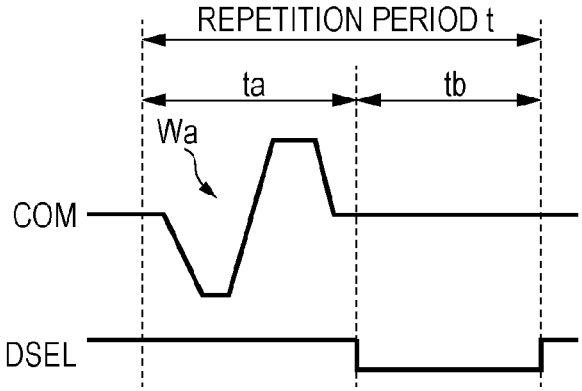
FIG. 5B is a diagram illustrating switch control in the single drive inspection.
Figure 5C:
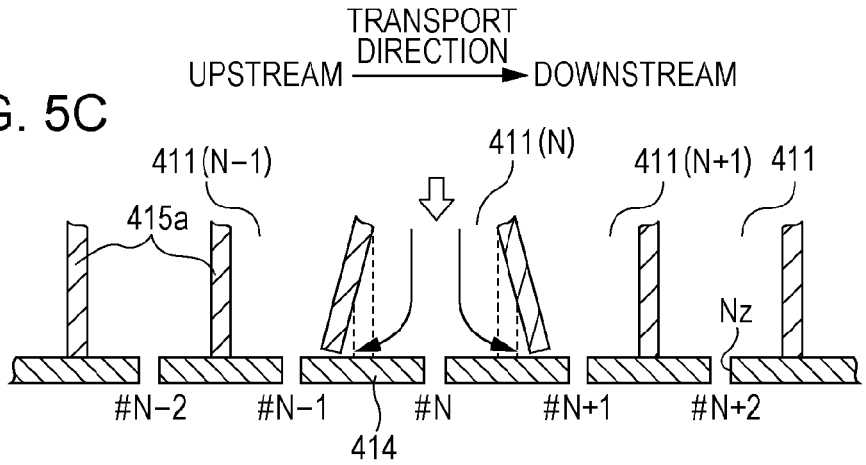
FIG. 5C is a diagram illustrating malfunction of a head.
Figure 5D:
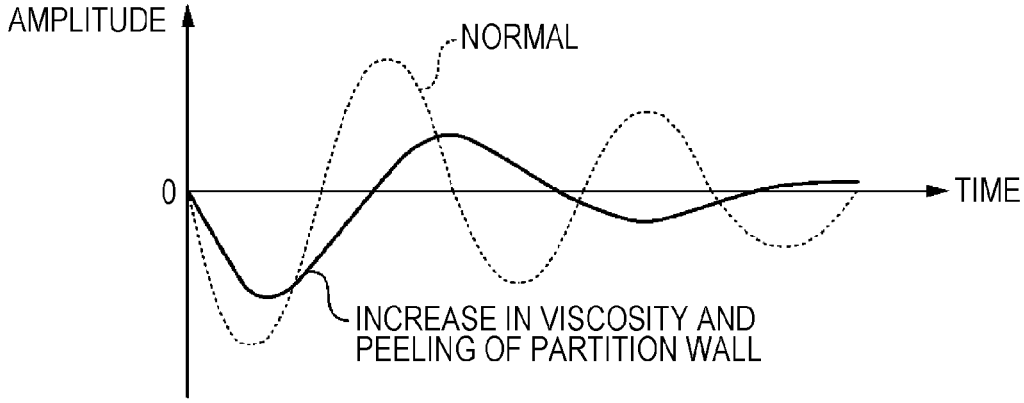
FIG. 5D is a diagram showing an example of a detecting signal for the single drive inspection.

FIG. 5A shows a flow of the single drive inspection, FIG. 5B is a diagram illustrating control of the switch 424 (FIG. 3B) in the single drive inspection, FIG. 5C is a diagram illustrating malfunction of the head 41, and FIG. 5D is a diagram showing an example of a detection signal (residual vibration) in the single drive inspection. In addition, FIG. 5C is a cross-sectional view of a part of the pressure chamber 411 when viewed in the moving direction of the head 41. In the graph in FIG. 5D, the vertical axis represents amplitude of the residual vibration, and the horizontal axis represents time. Hereinafter, a description will be given of an example of a method for inspecting one nozzle array formed in the lower surface of the head 41. In addition, the number of nozzles belonging to one nozzle array is assumed to be 180, and numbers are given in an order from a smallest number to the nozzles Nz positioned on the upstream side in the transport direction (#1, #2, . . . , #180).

First, the controller 10 sets an inspection nozzle #N as an inspection target from the nozzles #1 to #180 belonging to the nozzle array in a state where the lower surface of the head 41 is made to face the cap 44 at a home position (S001). For example, an inspection nozzle is set from the first nozzle #1 in order.

Then, the controller 10 performs "single drive" in which only the drive element 417 corresponding to the inspection nozzle #N is driven (S002). That is, the drive signal COM (ejection waveform Wa) is applied to the drive element 417 corresponding to the inspection nozzle #N while the drive signal COM is not applied to the drive elements 417 corresponding to non-inspection nozzles (nozzles other than #N) during the drive period ta in the repetition cycle t as shown in FIG. 5B. Therefore, the controller 10 transmits pixel data SI to the head control section 42 such that the switch 424 in the head control section 42 (FIG. 3B) corresponding to the inspection nozzle #N is turned on (connected state) and the switches 424 corresponding to the non-inspection nozzles are turned off (non-connected state) during the drive period ta. In addition, the gate signal DSEL is switched to the H level, and the switch 433 in the residual vibration detecting circuit 43 is turned on.

As a result, a pressure change occurs in the ink in the pressure chamber 411 corresponding to the inspection nozzle #N due to the ejection waveform Wa if the inspection nozzle #N is normal, and an ink droplet is ejected from the inspection nozzle #N to the cap 44. In addition, the pixel data SI during the head inspection may be created by the controller 10 or may be created by a printer driver.

Thereafter, the controller 10 transmits the pixel data to the head control section 42 such that only the switch 424 in the head control section 42 corresponding to the inspection nozzle #N is turned on and the switches 424 corresponding to the non-inspection nozzles are turned off during the inspection period tb. In addition, the gate signal DSEL is switched to the L level, and the switch 433 in the residual vibration detecting circuit 43 is turned off. As a result, the pulse signal POUT in accordance with the open circuit voltage (residual vibration) of the drive element 417 corresponding to the inspection nozzle #N is output from the residual vibration detecting circuit 43 to the controller 10. In doing so, the controller 10 obtains the residual vibration after the pressure change occurs in the ink in the pressure chamber 411 corresponding to the inspection nozzle #N due to the ejection waveform Wa (S003).

Thereafter, the controller 10 obtains a cycle Tc of the residual vibration based on the pulse signal POUT obtained during the inspection period tb and compares the detection cycle Tc and a first threshold value T1. If the detection cycle Tc is equal to or less than the first threshold value T1 (No in S004), the controller 10 determines that the inspection nozzle #N is an ejection failure nozzle (air bubble nozzle) which causes an ejection failure due to mixing in of air bubbles (S008).

On the other hand, if the detection cycle Tc is more than the first threshold value T1 (Yes in S004), the controller 10 compares the detection cycle Tc with a second threshold value T2. If the detection cycle Tc is less than the second threshold value T2 (Yes in S005), the controller 10 determines that the inspection nozzle #N is a normal nozzle which does not cause an ejection failure (S006). On the other hand, if the detection cycle Tc is equal to or more than the second threshold value (No in S005), the controller 10 determines that the inspection nozzle #N is a nozzle (re-inspection nozzle) with a possibility that an ejection failure has occurred due to an increase in viscosity of the ink (S007). The inspection of the inspection nozzle #N is completed as described above. Then, the controller 10 sets a new nozzle Nz as the inspection nozzle #N and repeats the above processing thereon until there are no uninspected nozzles (Yes in S009), and completes the single drive inspection. In addition, each of the first threshold value T1 and the second threshold value T2 is set in advance in accordance with a type of the ink, the ejection waveform Wa, and the like based on the residual vibration of the normal nozzle and the ejection failure nozzle and stored on the memory 13.

Incidentally, multiple nozzles Nz are aligned in a transport direction at minute intervals (intervals of 180 dpi, for example) in a nozzle array. Accordingly, a thickness of a partition wall 415*a* (a part of the flow path formation substrate 415) for sectioning the pressure chambers 411 which are aligned in the transport direction is extremely thin as shown in FIG. 5C. Therefore, there is a case where the partition wall 415*a* of the pressure chamber peels off from the nozzle plate 414 due to age-related degradation. If the partition wall 415*a* of the pressure chamber has peeled off, the ink (pressure) escapes from a part at which the partition wall 415 has peeled off to adjacent pressure chambers 411(N−1) and 411(N+1) even if the drive signal (ejection waveform Wa) is applied to the drive element 417 to cause the pressure chamber 411(N) to contract. Therefore, it is not possible to appropriately pressurize the ink in the pressure chamber 411 and eject a prescribed amount of ink from the nozzle Nz.

That is, an ejection failure occurs in the nozzle Nz not only by the mixing in of air bubbles and the increase in viscosity of the ink but also by peeling-off of the partition wall 415*a* of the pressure chamber from the nozzle plate 414. For this reason, it is necessary to inspect whether or not the partition wall 415*a* of the pressure chamber has peeled off from the nozzle plate 414 (that is, whether or not malfunction occurs in the head 41).

On the other hand, an experimental result is obtained that residual vibration has occurred in the same manner when the single drive is performed on the nozzle Nz in which the partition wall 415*a* of the pressure chamber has peeled off and when the single drive is performed on the nozzle Nz with the ink with increased viscosity contained therein as shown in FIG. 5D. That is, when the partition wall 415*a* of the pressure chamber has peeled off, an amplitude of the residual vibration becomes smaller and a vibration cycle becomes longer as compared with those in the normal time. This can be understood from the fact that the compliance C becomes larger and the angular velocity ω becomes smaller in the aforementioned Equation (2) when the partition wall 415*a* of the pressure chamber has peeled off.

Accordingly, the re-inspection nozzle whose detection cycle Tc of the residual vibration is equal to or more than the second threshold value T2 in the single drive inspection as shown in FIG. 5A has both a possibility that the ejection failure occurs due to the increase in the viscosity of the ink and a possibility that the ejection failure occurs due to peeling-off of the partition wall 415*a* of the pressure chamber. Therefore, the ejection failure cannot be solved when the partition wall 415*a* of the pressure chamber has peeled off even if only the single drive inspection (FIG. 5A) is performed, the nozzle whose second detection cycle Tc of the residual vibration is equal to or more than the second threshold value T2 is determined to be an increased viscosity nozzle, and the cleaning processing of the head 41 (the flushing processing or the pump suctioning processing) is performed. If the cleaning processing of the head 41 is nevertheless repeated, ink is unnecessarily consumed.

Thus, according to the first embodiment, a cause of an ejection failure in a re-inspection nozzle could be specified as being either of an increase in viscosity of the ink and peeling-off of the partition wall 415*a* of the pressure chamber when the re-inspection nozzle (corresponding to the failure nozzle) whose detection cycle Tc of the residual vibration is equal to or more than the second threshold value T2 has been detected in the single drive inspection (FIG. 5A). Therefore, simultaneous drive inspection shown below is performed.

Simultaneous Drive Inspection

Figure 6A:
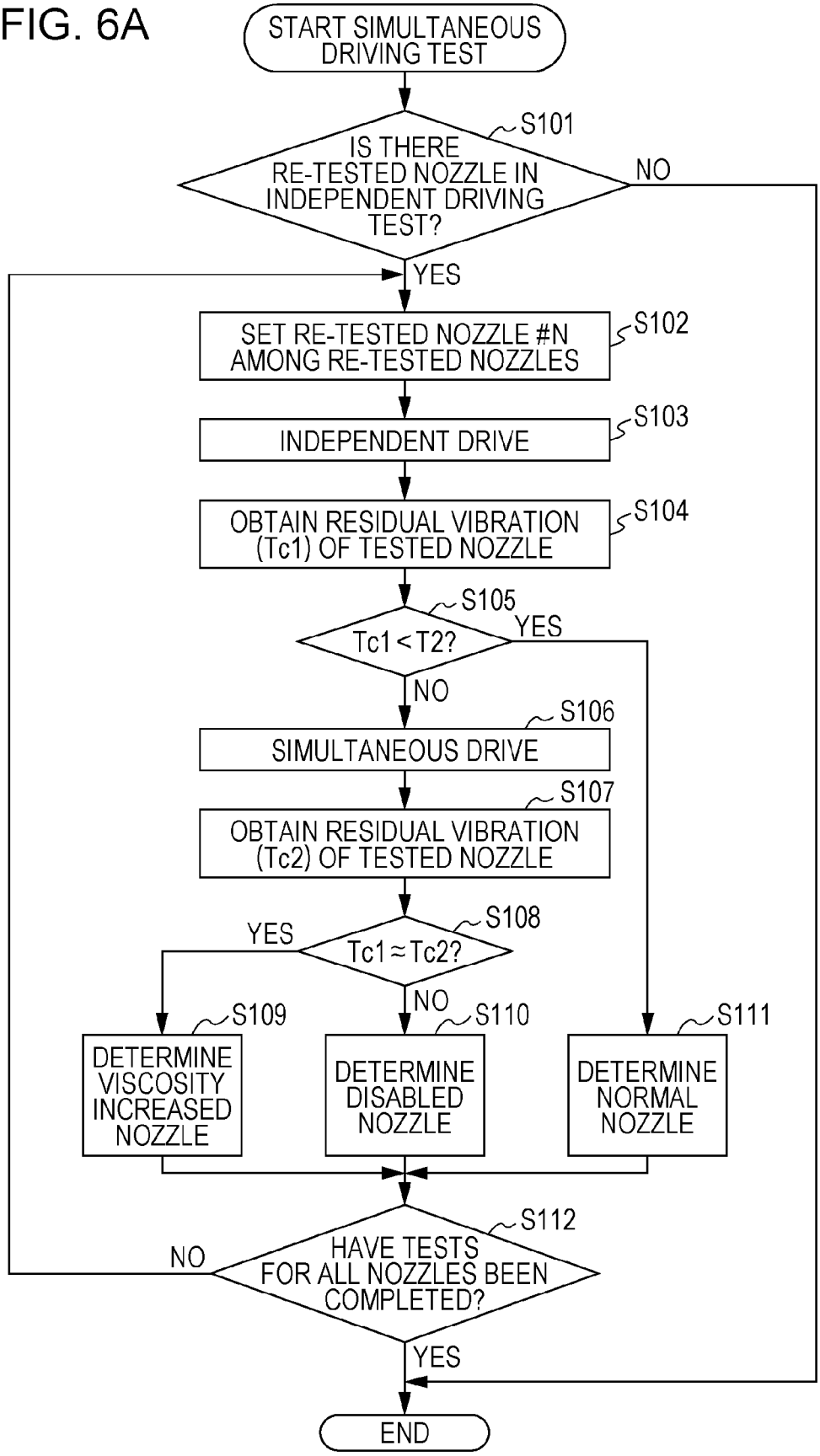
FIG. 6A shows a flow of simultaneous drive inspection.
Figure 6B:
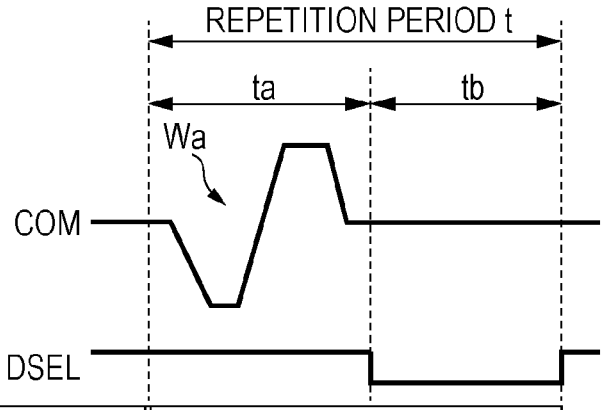
FIG. 6B is a diagram illustrating switch control in the simultaneous drive inspection.
Figure 6C:
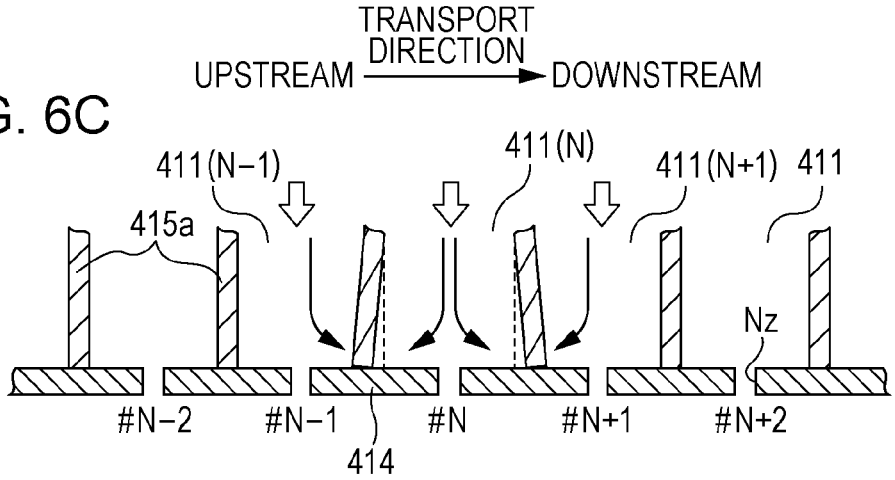
FIG. 6C is a diagram illustrating the simultaneous drive inspection.
Figure 6D:
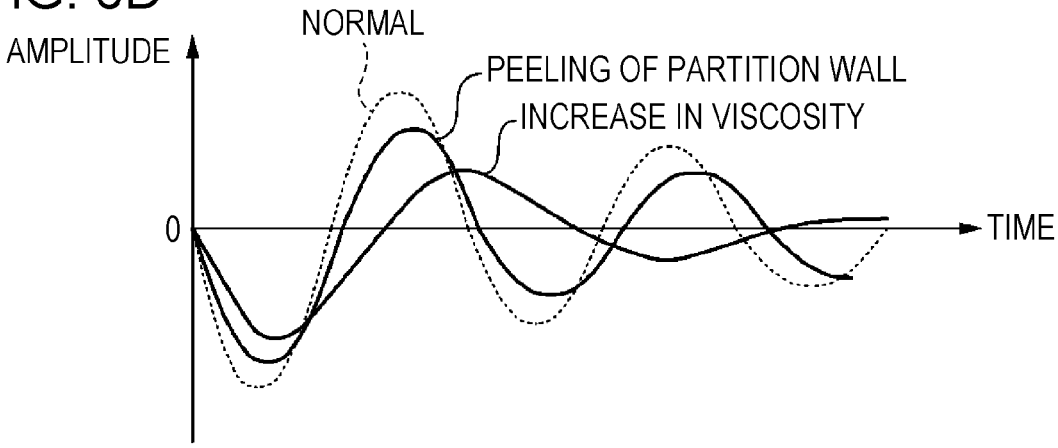
FIG. 6D is a diagram showing an example of a detection signal for the simultaneous drive inspection.

FIG. 6A shows a flow of the simultaneous drive inspection, FIG. 6B is a diagram illustrating control of the switch 424 (FIG. 3B) in the simultaneous drive inspection, FIG. 6C is a diagram illustrating the simultaneous drive, and FIG. 6D is a diagram showing an example of a detection signal (residual vibration) by the simultaneous drive inspection. First, in the simultaneous inspection, the controller 10 determines whether or not re-inspection nozzles have been detected in the single drive inspection (FIG. 5A) and completes the simultaneous drive inspection if the re-inspection nozzles have not been detected (No in S101).

On the other hand, if re-inspection nozzles have been detected in the single drive inspection (Yes in S101), the controller 10 sets an inspection nozzle #N as an inspection target among the re-inspection nozzles (S102). Then, the controller 10 performs single drive on the inspection nozzle #N (S103). That is, the controller 10 turns on only the switch 424 in the head controller section 42 corresponding to the inspection nozzle #N, turns off the switches 424 corresponding to the non-inspection nozzles (nozzles other than #N), switches the gate signal DSEL to the H level, turns on the switch 433 in the residual vibration detecting circuit 43, and applies the drive signal (ejection waveform Wa) only to the drive element 417 corresponding to the inspection nozzle #N during the drive period to as shown in FIG. 5B.

Thereafter, the controller 10 turns on only the switch 424 in the head control section 42 corresponding to the inspection nozzle #N, turns off the switches 424 corresponding to the non-inspection nozzles, switches the gate signal DSEL to the L level, and turns off the switch 433 in the residual vibration detecting circuit 43 during the inspection period tb. In doing so, the controller 10 obtains a pulse signal POUT in accordance with the open circuit voltage of the drive element 417 corresponding to the inspection nozzle #N, that is, the residual vibration of the inspection nozzle #N by the single drive from the residual vibration detecting circuit 43 (S104).

Then, the controller 10 obtains a cycle Tc1 of the residual vibration based on the pulse signal POUT from the residual vibration detecting circuit 43, compares the detection cycle Tc1 with the second threshold value T2, and determines that the inspection nozzle #N is a normal nozzle (S111) when the detection cycle Tc1 is less than the second threshold value T2 (Yes in S105). As described above, there is a case where increased viscosity ink is discharged from the re-inspection nozzle in the later processing (simultaneous drive in S106 as will be described later) and the re-inspection nozzle recovers to a normal nozzle even if the nozzle has been detected as the re-inspection nozzle in the aforementioned single drive inspection (FIG. 5A).

In such a case, the inspection of the inspection nozzle #N is completed, and a re-inspection nozzle which has not yet been inspected is newly set as an inspection nozzle #N (S102).

On the other hand, if the detection cycle Tc1 is equal to or more than the second threshold value T2 (No in S105), the controller 10 performs the simultaneous drive on the inspection nozzle #N (S106). In the simultaneous drive, the drive element 417 corresponding to the inspection nozzle #N, the drive element 417 corresponding to an adjacent nozzle #N−1 positioned on the upstream side in the transport direction with respect to the inspection nozzle #N, and the drive element 417 corresponding to an adjacent nozzle #N+1 positioned on the downstream side in the transport direction with respect to the inspection nozzle #N are simultaneously driven. Therefore, the controller 10 turns on the switches 424 in the head control sections 42 corresponding to the inspection nozzle #N and the adjacent nozzles #N−1 and #N+1, turns off the switches 424 corresponding to the other non-driven nozzles, switches the gate signal DSEL to the H level, and turns on the switch 433 in the residual vibration detecting circuit 43 during the drive period to in the repetition cycle t as shown in FIG. 6B. As a result, the drive signal (ejection waveform Wa) is applied to the drive elements 417 corresponding to the inspection nozzles #N and the adjacent nozzles #N−1 and #N+1.

Thereafter, the controller 10 turns on only the switch 424 in the head control section 42 corresponding to the inspection nozzle #N, turns off the switches 424 corresponding to the non-inspection nozzles including the adjacent nozzles #N−1 and #N+1, switches the gate signal DSEL to the L level, and turns off the switch 433 in the residual vibration detecting circuit 43 during the inspection period tb. In doing so, the controller 10 obtains the residual vibration of the inspection nozzle #N by the simultaneous drive from the residual vibration detecting circuit 43 (S107).

By driving not only the drive element 417 corresponding to the inspection nozzle #N but also the drive elements 417 corresponding to the adjacent nozzles #N−1 and #N+1, the ink in the pressure chambers 411(N−1) and 411(N+1) is also pressurized. Therefore, force of the ink (pressure) in the pressure chamber 411(N) attempting to move to the adjacent pressure chambers 411(N−1) and 411(N+1) is suppressed when the pressure chamber 411(N) contracts even if the partition wall 415*a* of the pressure chamber 411(N) corresponding to the inspection nozzle #N has peeled off from the nozzle plate 414 as shown in FIG. 6C. Accordingly, it is possible to more strongly pressurize the ink in the pressure chamber 411, the partition wall 415*a* of which has peeled off, in the simultaneous drive as compared with the case of the single drive.

Therefore, it is possible to cause the residual vibration of the nozzle, in which the partition wall 415*a* of the pressure chamber has peeled off, to further approach the residual vibration of the normal nozzle in the simultaneous drive (FIG. 6D) as compared with the case of the single drive (FIG. 5D). Specifically, an amplitude of the residual vibration becomes larger and the vibration cycle becomes shorter in the simultaneous drive as compared with those in the case of the single drive. On the other hand, there is no difference in the residual vibration of a nozzle with the increased viscosity ink contained therein between the single drive and the simultaneous drive. Therefore, the residual vibration occurs in the same manner in the nozzle with the increased viscosity ink contained therein and the nozzle whose partition wall 415*a* of the pressure chamber has peeled off during the single drive while the amplitude of the residual vibration becomes larger and the cycle of the residual vibration becomes shorter in the nozzle whose partition wall 415*a* of the pressure chamber has peeled off than in the nozzle with the increased viscosity ink contained therein during the simultaneous drive. That is, it is possible to differentiate the obtained detection signals (residual vibration) by differentiating the pressure change in the pressure chambers 411 of the adjacent nozzles #N−1 and #N+1 in the inspection by the single drive and the inspection by the simultaneous drive.

Thus, the controller 10 compares the detection cycle Tc1 of the residual vibration of the inspection nozzle #N in the single drive (S103) with a detection cycle Tc2 of the residual vibration of the inspection nozzle #N in the simultaneous drive (S106). Then, if the two detection cycles Tc1 and Tc2 are substantially the same (Yes in S108), the controller 10 determines that the inspection nozzle #N is the increased viscosity nozzle which causes an ejection failure due to an increase in viscosity of the ink (S109). On the other hand, if the two detection cycles Tc1 and Tc2 are different from each other (more specifically, if the detection cycle Tc2 in the simultaneous drive is shorter than the detection cycle Tc1 in the single drive) (No in S108), the controller 10 determines that the inspection nozzle #N is a malfunction nozzle which causes an ejection failure due to peeling-off of the partition wall 415*a* of the pressure chamber from the nozzle plate 414 (S110). When the difference between the two detection cycles Tc1 and Tc2 is compared with a threshold value, it may be determined that the inspection nozzle #N is an increased viscosity nozzle when the difference is equal to or less than the threshold value, and it may be determined that the inspection nozzle #N is a malfunction nozzle when the difference is more than the threshold value.

As described above, the controller 10 specifies a cause of the ejection failure of the re-inspection nozzle based on the residual vibration in the single drive and the residual vibration in the simultaneous drive. That is, the controller 10 specifies whether the viscosity of ink has been increased or whether the partition wall 415*a* of the pressure chamber has peeled off. The controller 10 repeats the aforementioned processing until there are no re-inspection nozzles which have not yet been inspected (Yes in S112), and completes the simultaneous drive inspection.

Then, the pump suctioning processing may be performed when an air bubble nozzle has been detected, for example, and the flushing processing may be performed when the air bubble nozzle has not been detected while the increased viscosity nozzle has been detected in the above inspection. In doing so, it is possible to suppress ink consumption, recover the air bubble nozzle or the increased viscosity nozzle to a normal nozzle, and suppress degradation of quality of a printed image. In addition, when a malfunction nozzle whose partition wall 411 of the pressure chamber has peeled off is detected, information on the malfunction nozzle may be transmitted to the printer drive, and print data without using the malfunction nozzle may be created. In doing so, it is possible to print an image without using the malfunction nozzle and suppress degradation of quality of the printed image. However, the embodiment is not limited thereto, and a user may be informed of the malfunction of the head 41 and receive an instruction for replacement of the head 41.

Conclusion

As described above, the controller 10 (control section) obtains residual vibration (first detection signal) in the single drive (first drive) in which the drive signal (ejection waveform Wa) is applied to the drive element 417 corresponding to the inspection nozzle #N (inspection target nozzle) while the drive signal is not applied to the drive elements 417 corresponding to the nozzles #N−1 and #N+1 next to the inspection nozzle and residual vibration (second detection signal) in the simultaneous drive (second drive) in which the drive signal is applied to the drive element 417 corresponding to the inspection nozzle #N and the drive elements 417 corresponding to the adjacent nozzles (next nozzles) #N−1 and #N+1 in the first embodiment. That is, the controller 10 obtains residual vibration by differentiating the pressure changes in the pressure chambers 411 of the adjacent nozzles #N−1 and #N+1 in the inspection by the single drive and the inspection by the simultaneous drive. Then, it is inspected whether or not the head 41 will recover by the cleaning processing (the flushing processing or the pump suctioning processing) of the head 41 for recovering from the ink ejection failure of the nozzle NZ based on the obtained residual vibration.

In doing so, it is possible to detect a nozzle which causes the ejection failure due to mixing in of air bubbles or an increase in viscosity of the ink, also detect malfunction of the head 41, namely a nozzle whose partition wall 415*a* of the pressure chamber has peeled off from the nozzle plate 414, and suppress degradation of quality of a printed image by the ejection failure nozzle. In addition, it is possible to separately specify an ejection failure due to an increase in viscosity of the ink and an ejection failure due to peeling-off of the partition wall 415*a* of the pressure chamber by performing both the single drive and the simultaneous drive. Therefore, it is possible to perform processing in accordance with each cause of the ejection failure and prevent the ink from being unnecessarily consumed by performing the cleaning processing of the head 41 when the partition wall 415*a* of the pressure chamber has peeled off.

In addition, the ink is not ejected from the adjacent nozzles #N−1 and #N+1 in the single drive, and the ink is ejected from the adjacent nozzles #N−1 and #N+1 in the simultaneous drive. In doing so, it is possible to differentiate the pressure changes in the pressure chambers 411 of the adjacent nozzles #N−1 and #N+1 in the single drive and the simultaneous drive.

In addition, the drive element 417 corresponding to the inspection nozzle #N and the drive elements 417 corresponding to the nozzles #N−1 and #N+1 on both sides of the inspection nozzle are driven in the simultaneous drive in the first embodiment.

In doing so, it is possible to pressurize the ink in the pressure chamber 411 which is adjacent to a peeling side in the simultaneous drive even when one side of the partition wall 415*a* of the pressure chamber 411 has peeled off. Therefore, it is possible to more reliably pressurize the ink in the pressure chamber 411, the partition wall 415*a* of which has peeled off, and increase the difference between the residual vibration by the single drive and the residual vibration by the simultaneous drive. Accordingly, it is possible to more precisely distinguish the malfunction nozzle whose partition wall 415*a* of the pressure chamber has peeled off from the increased viscosity nozzle.

In the first embodiment, the controller 10 inspects the re-inspection nozzle (failure nozzle) based on the residual vibration (detection signal) obtained by performing the single drive (first drive) on the plurality of nozzles in order, then sets the detected re-inspection nozzle as an inspection target nozzle, obtains the residual vibration (first detection signal) in the single drive and the residual vibration (second detection signal) in the simultaneous drive, and inspects the head. In addition, the expression that the failure nozzle is detected based on the residual vibration obtained by performing the single drive on the plurality of nozzles in order means that another nozzle is set as an inspection target nozzle and the single drive is performed thereon after a certain nozzle among the plurality of nozzles as inspection targets is set as an inspection target nozzle and the single drive is performed thereon and before the simultaneous drive is performed on the nozzle.

In doing so, only the single drive is performed on all the nozzles in advance, and therefore, it is possible to facilitate the control by the controller 10. In addition, since the simultaneous drive inspection (FIG. 6A) is not performed when the re-inspection nozzle is not detected in the single drive inspection (FIG. 5A), it is possible to minimize the inspection time of the head 41. Although the above embodiment was described as a case where only one nozzle array was inspected, the embodiment is not limited thereto. For example, the simultaneous drive inspection may be performed after the single drive inspection is performed on all the nozzles belonging to the head 41. Alternatively, the single drive inspection may be performed on another nozzle array and the simultaneous drive inspection may be performed thereon after the single drive inspection is performed on a certain nozzle array and the simultaneous drive inspection is performed thereon.

In addition, the controller 10 inspects the head 41 (determines which one out of the malfunction nozzle and the increased viscosity nozzle the inspection nozzle #N is) based on the residual vibration respectively obtained by sequentially performing the single drive (first drive, S103 in FIG. 6A) and the simultaneous drive (second drive, S106) on the same inspection nozzle #N. In addition, the expression that the single drive and the simultaneous drive are sequentially performed on the same inspection nozzle #N means that the simultaneous drive is performed on a certain nozzle after the nozzle among the plurality of nozzles as inspection targets is set as an inspection target nozzle and single drive is performed thereon and before another nozzle is set as an inspection target nozzle and the single drive is performed thereon.

If the timing of the single drive significantly deviates from the timing of the simultaneous drive, there is a concern that a state of the inspection nozzle changes. For example, there is a concern that viscosity of the ink in the detected nozzle may increase due to the peeling-off of the partition wall 415*a* of the pressure chamber during the single drive, the difference between the residual vibration by the single drive and the residual vibration (cycle) by the simultaneous drive may decrease, and the malfunction (peeling-off of the partition wall 415*a* of the pressure chamber) of the head 41 cannot be detected. Therefore, it is possible to more precisely distinguish the malfunction nozzle from the increased viscosity nozzle by sequentially performing the single drive and the simultaneous drive on the same inspection nozzle #N.

In addition, ink droplets are ejected not only from the inspection nozzle #N but also from the adjacent nozzles #N−1 and #N+1 in the simultaneous drive inspection (FIG. 6A). Therefore, there is a possibility that increased viscosity ink is discharged from the re-inspection nozzle in which the viscosity of the ink is determined to have increased in the single drive inspection (FIG. 5A) in the course of the simultaneous drive inspection and the re-inspection nozzle has recovered to a normal nozzle. Thus, according to the first embodiment, the detection cycle Tc1 of the residual vibration by the single drive is compared with the second threshold value T2 (S105) after the single drive is performed on the inspection nozzle #N (re-inspection nozzle) (S103) and before the simultaneous drive is performed (S106) in the simultaneous drive inspection (FIG. 6A). In doing so, it is possible to omit the simultaneous drive processing (S106) on the re-inspection nozzle which has recovered in the course of the simultaneous drive inspection and minimize the inspection time of the head 41.

Second Embodiment

Method for Inspecting Head 41

Figure 7:
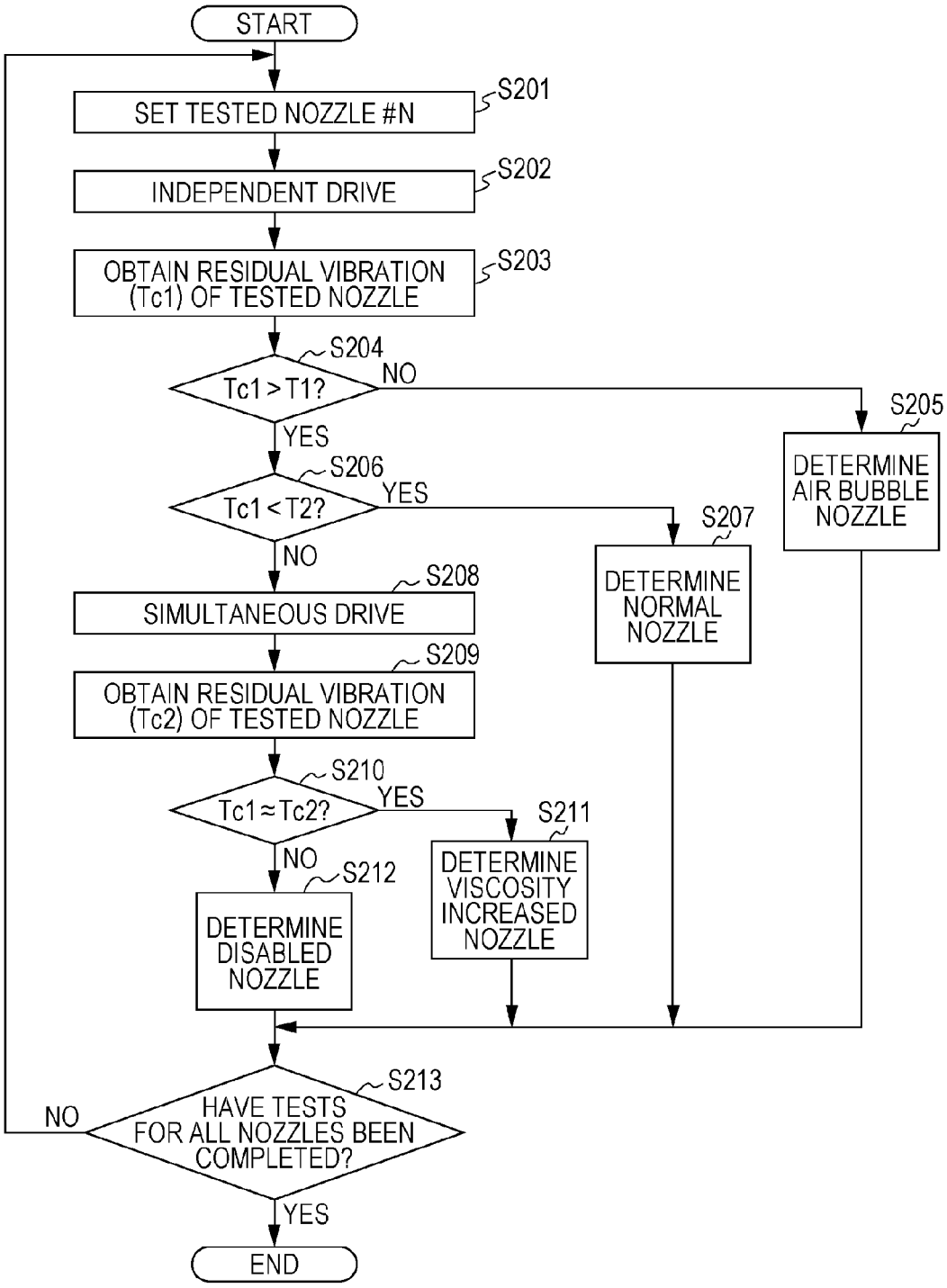
FIG. 7 shows a head inspection flow according to a second embodiment.

FIG. 7 shows an inspection flow of the head 41 according to the second embodiment. In the aforementioned first embodiment, the simultaneous drive inspection (FIG. 6A) is performed on the nozzle which has been determined to be a re-inspection nozzle after the single drive inspection (FIG. 5A) is performed on all the nozzles as inspection targets. On the other hand, the simultaneous drive inspection is sequentially performed on the inspection nozzle #N in the course of the single drive inspection when the inspection nozzle #N is determined to be a re-inspection nozzle according to the second embodiment.

A specific description will be given based on the flow in FIG. 7. First, the controller 10 sets an inspection nozzle #N among nozzles belonging to a nozzle array (or head 41) (S201) and performs single drive on the inspection nozzle #N (S202). That is, the controller 10 turns on only the switch 424 in the head control section 42 corresponding to the inspection nozzle #N, turns off the switches 424 corresponding to the non-inspection nozzles (nozzles other than #N), switches the gate signal DSEL to the H level, turns on the switch 433 in the residual vibration detecting circuit 43, and applies the drive signal (ejection waveform Wa) only to the drive element 417 corresponding to the inspection nozzle #N during the drive period to as shown in FIG. 5B.

Thereafter, the controller 10 turns on only the switch 424 in the head control section 42 corresponding to the inspection nozzle #N, turns off the switches 424 corresponding to the non-inspection nozzles, switches the gate signal DSEL to the L level, and turns off the switch 433 in the residual vibration detecting circuit 43 in the inspection period tb. Then, the residual vibration (pulse signal POUT) of the inspection nozzle #N by the single drive is obtained (S203).

Then, the controller 10 determines that the inspection nozzle #N is the air bubble nozzle (S205) when the detection cycle Tc1 of the residual vibration by the single drive is equal to or less than the first threshold value T1 (No in S204). On the other hand, when the cycle Tc1 of the residual vibration by the single drive is more than the first threshold value T1 (Yes in S204), the controller 10 compares the detection cycle Tc1 of the residual vibration by the single drive with the second threshold value T2. When the detection cycle Tc1 is less than the second threshold value T2 (Yes in S206), the controller 10 determines that the inspection nozzle #N is a normal nozzle (S207).

On the other hand, when the detection cycle Tc1 is equal to or more than the second threshold value T2 (No in S206), the controller 10 performs the simultaneous drive on the inspection nozzle #N (S208). That is, the controller 10 turns on the switches 424 in the head control sections 42 corresponding to the inspection nozzle #N and the adjacent nozzles #N−1 and #N+1, turns off the switches 424 corresponding to the non-driven nozzles (nozzles other than #N−1 to #N+1), switches the gate signal DSEL to the H level, turns on the switch 433 in the residual vibration detecting circuit 43, and applies the drive signal (ejection waveform Wa) to the drive elements 417 corresponding to the inspection nozzles #N and the adjacent nozzles #N−1 and #N+1 during the drive period to as shown in FIG. 6B.

Thereafter, the controller 10 turns on only the switch 424 in the head control section 42 corresponding to the inspection nozzle #N, turns off the switches 424 corresponding to the non-inspection nozzles including the adjacent nozzles #N−1 and #N+1, switches the gate signal DSEL to the L level, and turns off the switch 433 in the residual vibration detecting circuit 43 during the inspection period tb. In so doing, the residual vibration (pulse signal POUT) of the inspection nozzle #N by the simultaneous drive is obtained (S209).

Then, the controller 10 obtains the cycle Tc2 of the residual vibration by the simultaneous drive and compares the cycle Tc2 with the cycle Tc1 of the residual vibration by the single drive (S210). When the two detection cycles Tc1 and Tc2 are substantially the same (Yes in S210), the controller 10 determines that the inspection nozzle #N is an increased viscosity nozzle (S211). On the other hand, when the two detection cycles Tc1 and Tc2 are different from each other (specifically, when the detection cycle Tc2 of the simultaneous drive is shorter than the detection cycle Tc1 of the single drive) (No in S210), the controller 10 determines that the inspection nozzle #N is a malfunction nozzle whose partition wall 415*a* of the pressure chamber has peeled off (S212). As described above, the controller 10 repeats the above processing until there are no uninspected nozzles (Yes in S213) and completes the inspection of the head 41.

As described above, the single drive (S202) and the simultaneous drive (S208) are sequentially performed on the same inspection nozzle #N according to the second embodiment.

For this reason, it is possible to determine a state of the inspection nozzle #N based on the detection signals (the residual vibration by the single drive and the residual vibration by the simultaneous drive) of the inspection nozzle #N in the same state. Accordingly, it is possible to more precisely distinguish the malfunction nozzle from the increased viscosity nozzle.

Third Embodiment

Method for Inspecting Head 41

Figure 8A:
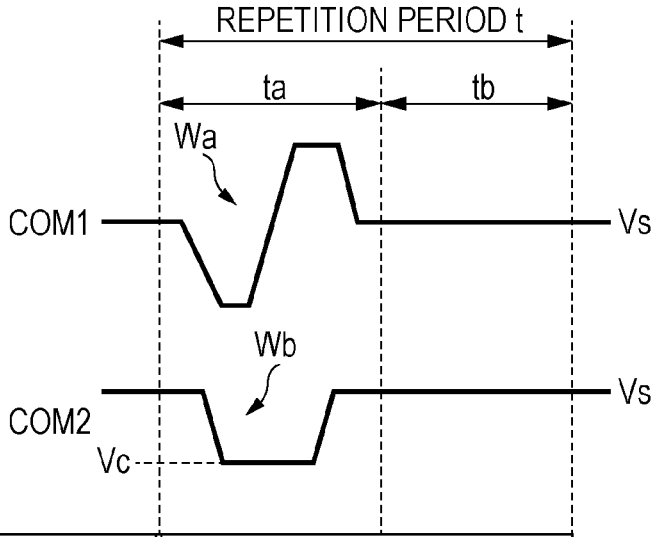
FIG. 8A is a diagram illustrating a drive signal according to a third embodiment.
Figure 8B:
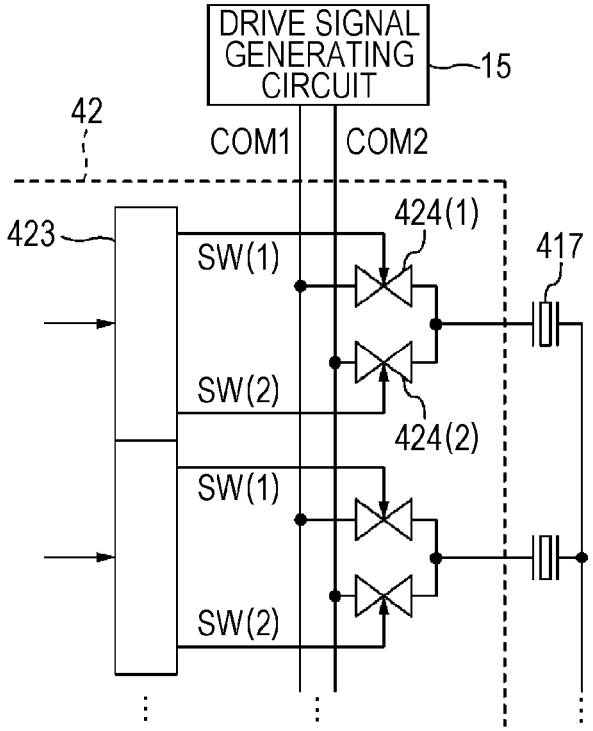
FIG. 8B is a diagram illustrating a head control section in the third embodiment.

FIG. 8A is a diagram illustrating the drive signal COM according to the third embodiment, and FIG. 8B is a diagram illustrating (a part of) the head control section 42 according to the third embodiment. In the aforementioned first embodiment, the inspection of the head 41 is performed when printing is stopped. On the other hand, the inspection of the head 41 is performed during printing of an image on the medium S according to the third embodiment. However, nozzles which eject ink droplets are determined in accordance with print data (pixel data SI) during printing. That is, if the image data SI[1] for forming dots is not allocated to the inspection nozzle #N and the adjacent nozzles #N−1 and #N+1, it is necessary to drive the drive elements 417 corresponding to the nozzles #N−1 to #N+1 for inspection. Thus, a first drive signal COM1 of an ejection waveform Wa generated during the drive period ta and a second drive signal COM2 of a minute vibration waveform Wb generated during the drive period ta are used in the third embodiment.

In order to use two kinds of drive signals COM1 and COM2, two kinds of switches 424(1) and 424(2) are provided for each drive element 417 in the head control section 42 (FIG. 8B). In addition, the first drive signal COM1 is input to the first switch 424(1), and the second drive signal COM2 is input to the other second switch 424(2). In addition, the level shifter 423 outputs two kinds of switch control signals SW(1) and SW(2) in accordance with the respective switches 424(1) and 424(2).

The minute vibration waveform Wb is a waveform for minutely vibrating the ink in the nozzle Nz and the pressure chamber 411 without ejecting an ink droplet from the nozzle Nz. Specifically, the pressure chamber 411 expands due to a waveform part which lowers potential from the standby potential Vs to the predetermined potential Vc, and a meniscus (a free surface of the ink exposed from a nozzle opening) of the nozzle Nz is drawn to the side of the pressure chamber 411. Thereafter, the meniscus freely vibrates, and the ink in the nozzle Nz and the like minutely vibrates to an extent to which the ink is not ejected from the nozzle Nz during a period in which a waveform part which maintains the predetermined potential Vc is applied to the drive element 417. Therefore, the ink in the nozzle Nz and the like is stirred, and it is possible to suppress an increase in viscosity of the ink. Finally, the pressure chamber 411 returns to the original state by the waveform part which raises the potential from the predetermined potential Vc to the standby potential Vs. That is, it is possible to suppress an increase in viscosity of the ink (clogging) even when the ink is not ejected and drive the drive element 417 for the inspection by applying the minute vibration waveform Wb to the drive element 417 corresponding to the nozzle Nz to which the pixel data SI[0] of not forming a dot is allocated.

The controller 10 selects a repetition cycle t during which the pixel data SI[0] of not forming a dot is allocated to the adjacent nozzles #N−1 and #N+1 of the inspection nozzle #N in order to perform the "single drive" on the inspection nozzle #N during the printing (S002 in FIG. 5A, S103 in FIG. 6A, and S202 in FIG. 7). Then, the controller 10 turns off the first switches 424(1) and the second switches 424(2) in the head control sections 42 corresponding to the adjacent nozzles #N−1 and #N+1 during the drive period to in the selected repetition cycle t. That is, any of the drive signals COM1 and COM2 are not applied to the drive elements 417 corresponding to the adjacent nozzles #N−1 and #N+1.

Then, when the pixel data SI[1] for forming a dot is allocated to the inspection nozzle #N, the controller 10 turns on the first switch 424(1) corresponding to the inspection nozzle #N, turns off the second switch 424(2), and applies the first drive signal COM1 (ejection waveform Wa) to the drive element 417 corresponding to the inspection nozzle #N. On the other hand, when the pixel data SI[0] of not forming a dot is allocated to the inspection nozzle #N, the controller 10 turns off the first switch 424(1) corresponding to the inspection nozzle #N, turns on the second switch 424(2), and applies the second drive signal COM2 (minute vibration waveform Wb) to the drive element 417 corresponding to the inspection nozzle #N.

In addition, the gate signal DSEL is switched to the H level, and the switch 433 in the residual vibration detecting circuit 43 is turned on during the drive period ta. In addition, the switches 424(1) and 424(2) of the nozzles other than the inspection nozzle #N and the adjacent nozzle #N−1 are controlled in accordance with the pixel data SI. Moreover, the residual vibration occurs in different manners when the ejection waveform Wa is applied to the drive element 417 and the minute vibration waveform Wb is applied to the drive element 417 even if the states of the nozzle Nz are the same. For this reason, it is preferable to differentiate the threshold values (the first threshold value T1 from the second threshold value T2 for the cycles of the residual vibration) in accordance with the waveforms Wa and Wb.

Thereafter, the controller 10 turns on the first switch 424(1) corresponding to the inspection nozzle #N (or the second switch 424(2)) and turns off the first switches 424(1) and the second switches 424(2) corresponding to the nozzles other than the inspection nozzle #N during the inspection period tb. In addition, the gate signal DSEL is switched to the L level, and the switch 433 in the residual vibration detecting circuit 43 is turned off during the inspection period tb. In doing so, it is possible to detect the residual vibration of the inspection nozzle #N by the single drive in which the drive element 417 corresponding to the inspection nozzle #N is driven by the ejection waveform Wa or the minute vibration waveform Wb while the drive elements 417 corresponding to the adjacent nozzles #N−1 and #N+1 are not driven.

On the other hand, when the "simultaneous drive" is performed on the inspection nozzle #N during the printing (example: S106 in FIG. 6A and S208 in FIG. 7), it is possible to perform the inspection in any repetition cycle t regardless of the pixel data SI. For example, when the pixel data SI[1] for forming a dot is allocated to the inspection nozzle #N and the adjacent nozzles #N−1 and #N+1, the controller 10 turns on the first switches 424(1) corresponding to the respective nozzles, turns off the second switches 424(2), and applies the first drive signal COM1 (ejection waveform Wa) to the drive elements 417 during the drive period ta. On the other hand, when the pixel data SI[0] of not forming a dot is allocated to the inspection nozzle #N and the adjacent nozzles #N−1 and #N+1, the controller 10 turns off the first switches 424(1) corresponding to the respective nozzles, turns on the second switches 424(2), and applies the second drive signal COM2 (minute vibration waveform Wb) to the drive element 417.

Thereafter, the controller 10 turns on the first switch 424(1) (or the second switch 424(2)) corresponding to the inspection nozzle #N and turns off the first switches 424(1) and the second switches 424(2) corresponding to the nozzles other than the inspection nozzle #N during the inspection period tb. In doing so, it is possible to detect the residual vibration of the inspection nozzle #N by the simultaneous drive in which the drive elements 417 corresponding to the inspection nozzle #N and the adjacent nozzles #N−1 and #N+1 are driven by the ejection waveform Wa or the minute vibration waveform Wb.

As described above, the controller 10 does not drive the drive elements 417 corresponding to the adjacent nozzles #N−1 and #N+1 of the inspection nozzle #N and controls the adjacent nozzles #N−1 and #N+1 so as not to eject ink droplets in the single drive. In addition, although the controller 10 drives the drive elements 417 corresponding to the adjacent nozzles #N−1 and #N+1, the controller 10 controls the adjacent nozzles #N−1 and #N+1 so as not to eject ink droplets in accordance with the pixel data SI (print data) allocated to the adjacent nozzles #N−1 and #N+1 in the simultaneous drive. In doing so, it is possible to print an image in accordance with the print data.

Fourth Embodiment

Method for Inspecting Head 41

Figure 9:
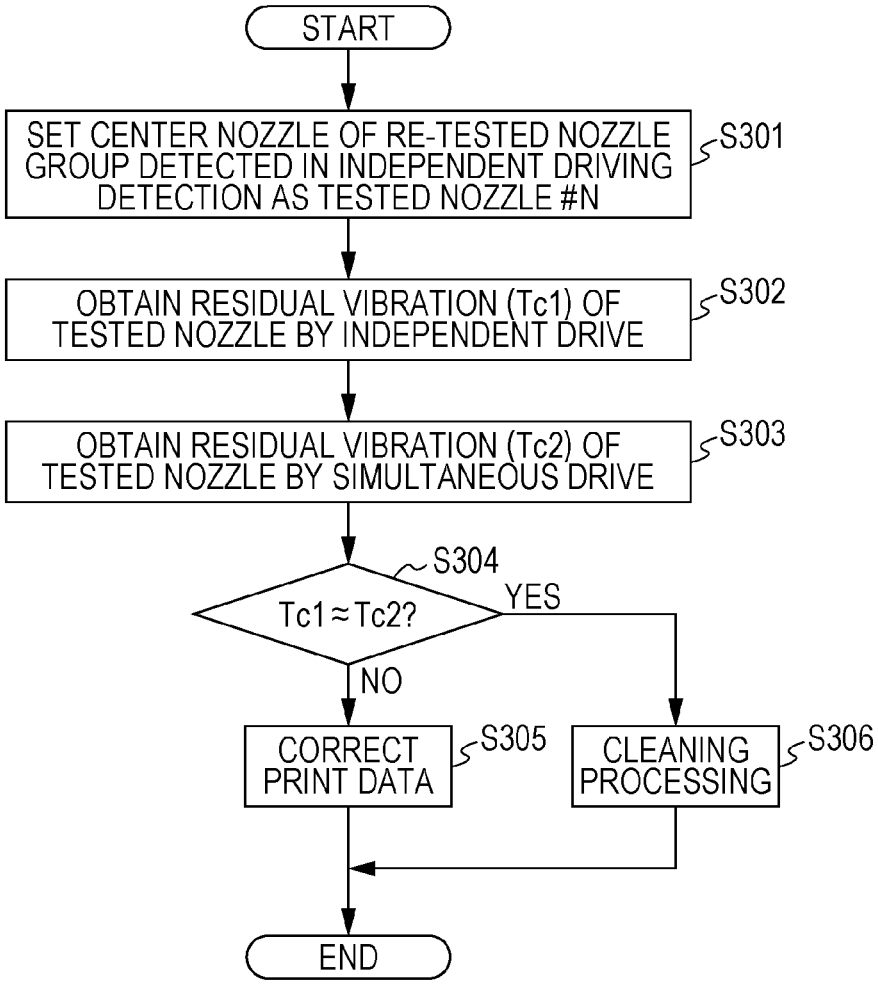
FIG. 9 shows a head inspection flow according to a fourth embodiment.

FIG. 9 shows an inspection flow of the head 41 according to the fourth embodiment. The phenomenon that the partition wall 415*a* of the pressure chamber peels off from the nozzle plate 414 easily occurs in the plurality of pressure chambers 411 which are sequentially aligned in the transport direction. In addition, a nozzle at a center of a nozzle group, in which the partition walls 415*a* of the pressure chambers have peeled off, in the transport direction tends to have a higher degree of peeling.

Thus, according to the fourth embodiment, the controller 10 firstly sets a nozzle (example: nozzle #20) at the center of a re-inspection nozzle group (example: nozzles #10 to #30) in the transport direction as an inspection nozzle #N when the plurality of nozzles Nz sequentially aligned in the transport direction are detected as the re-inspection nozzles (corresponding to the failure nozzles) in the aforementioned single drive inspection shown in FIG. 5A (S301). Then, the controller 10 performs the single drive on the inspection nozzle #N (the center nozzle) and obtains the residual vibration (pulse signal POUT) of the inspection nozzle #N by the single drive (S302). Thereafter, the controller 10 performs the simultaneous drive on the inspection nozzle #N and the adjacent nozzles #N−1 and #N+1 and obtains the residual vibration of the inspection nozzle #N by the simultaneous drive (S303).

Then, the controller 10 compares the cycle Tc1 of the residual vibration by the single drive and the cycle Tc2 of the residual vibration by the simultaneous drive and determines that the inspection nozzle #N is an increased viscosity nozzle if the two detection cycles Tc1 and Tc2 are substantially the same (Yes in S304). In addition, when the partition wall 415*a* of the pressure chamber has not peeled off in the center nozzle (the inspection nozzle #N) in the re-inspection nozzle group, there is a high possibility that the partition walls 415*a* of the pressure chambers have not peeled off in the other nozzles in the re-inspection nozzle group and viscosity of the ink increases. Thus, the controller 10 performs the cleaning processing of the head 41 (S306) without performing the inspection (S302 and S303) on the other nozzles in the re-inspection nozzle group when the inspection nozzle #N (center nozzle) is determined to be an increased viscosity nozzle.

It is possible to prevent degradation of quality of a printed image due to the increased viscosity nozzle by recovering the re-inspection nozzle group to normal nozzles as described above. In addition, it may be checked whether or not the ejection failure has been recovered from by inspecting a part of the nozzles in the re-inspection nozzle group, for example, after the cleaning processing.

On the other hand, when the two detection cycles Tc1 and Tc2 are different from each other (No in S304), it is possible to determine that the inspection nozzle #N is a malfunction nozzle (a nozzle whose partition wall 415*a* of the pressure chamber has peeled off). When the partition wall 415*a* of the pressure chamber has peeled off at the center nozzle (the inspection nozzle #N) in the re-inspection nozzle group, there is a high possibility that the partition walls 415*a* of the pressure chambers of the other nozzles in the re-inspection nozzle group have also peeled off. Thus, when the inspection nozzle #N (center nozzle) is determined to be a malfunction nozzle, the controller 10 regards all the nozzles belonging to the re-inspection nozzle group as malfunction nozzles without performing the inspection (S302 and S303) on all the other nozzles in the re-inspection nozzle group and corrects the print data so as not to use the malfunction nozzle group (S305). However, the embodiment is not limited thereto, and replacement of the head 41 may be instructed by transmitting information on the malfunction nozzle group to a printer driver or informing a user of the malfunction of the head 41, for example. In doing so, it is possible to prevent degradation of quality of a printed image due to the malfunction nozzles.

According to the fourth embodiment, the controller 10 firstly sets a re-inspection nozzle positioned at the center of the re-inspection nozzle group in the transport direction as an inspection nozzle when the plurality of nozzles Nz sequentially aligned in the transport direction (predetermined direction) are detected as the re-inspection nozzles (nozzles with increased viscosity ink contained therein or malfunction nozzles) as described above. In doing so, it is possible to omit the inspection (S302 and S303) on the other nozzles in the re-inspection nozzle group and shorten the inspection time of the head 41. In addition, the nozzle positioned at the "center" of the re-inspection nozzle group (the plurality of failure nozzles sequentially aligned in the transport direction) in the transport direction corresponds to one of nozzles other than the nozzles positioned at both ends of the re-inspection nozzle group in the transport direction, and preferably corresponds to one of nozzles belonging to a center area when the re-inspection nozzle group is divided into three parts in the transport direction.

MODIFICATION EXAMPLES

Method for Inspecting Head 41

First Modification Example

Although the drive elements 417 corresponding to the inspection nozzle #N and nozzles #N−1 and #N+1 on both sides thereof, that is, three drive elements 417 are simultaneously driven during the simultaneous drive (S106 in FIG. 6A and S208 in FIG. 7) in the aforementioned embodiment, the embodiment is not limited thereto. For example, the drive elements 417 corresponding to the inspection nozzle #N and one of the adjacent nozzles of the inspection nozzle #N, that is, two drive elements 417 may be simultaneously driven in the simultaneous drive.

For example, the drive elements 417 corresponding to the inspection nozzle #N and a plurality of nozzles (#N−1, #N−2,

#N−3, . . . , #N+1, #N+2, #N+3, . . . ) sequentially aligned on both sides of the inspection nozzle #N in the transport direction may be simultaneously driven in the simultaneous drive. The phenomenon that the partition wall 415*a* of the pressure chamber peels off from the nozzle plate 414 easily occurs in a plurality of pressure chambers 411 sequentially aligned in the transport direction. For this reason, it is possible to reliably pressurize the ink in the pressure chamber 411 of the inspection nozzle #N whose partition wall 415*a* has peeled off by driving not only the drive elements 417 corresponding to the nozzles #N−1 and #N+1 on both sides of the inspection nozzle #N but also the drive elements 417 corresponding to a plurality of nozzles in the vicinity of the inspection nozzle #N. Therefore, it is possible to increase the difference between the residual vibration by the single drive and the residual vibration by the simultaneous drive and more precisely distinguish the malfunction nozzle (the nozzle whose partition wall 415*a* of the pressure chamber has peeled off from the increased viscosity nozzle.

Second Modification Example

Although the single drive is performed again on the re-inspection nozzle which is detected in the single drive inspection shown in FIG. 5A and residual vibration is obtained in the simultaneous drive inspection shown in FIG. 6A according to the aforementioned first embodiment (S103 and S104), the embodiment is not limited thereto. For example, the residual vibration obtained in the single drive inspection (S002 and S003) shown in FIG. 5A may be compared with the residual vibration obtained in the simultaneous drive inspection (S106 and S107) shown in FIG. 6A.

Third Modification Example

Although the drive signal COM shown in FIG. 3A is exemplified in the aforementioned first embodiment, the embodiment is not limited thereto. For example, the drive signal COM generated by the minute vibration waveform Wb before the ejection waveform Wa may be used, and the minute vibration waveform Wb may be applied to the drive elements 417 corresponding to the nozzles other than the inspection nozzle #N in the inspection of the head 41. In doing so, it is possible to suppress an increase in viscosity of the ink in the nozzle Nz in the inspection of the head 41. In addition, the residual vibration may be obtained by applying the minute vibration waveform Wb to the drive element 417 corresponding to the inspection nozzle #N.

Fourth Modification Example

Although the state of the nozzle Nz is determined based on the cycle of the residual vibration in the aforementioned embodiments, the embodiments are not limited thereto. For example, the state of the nozzle Nz may be determined based on another parameter such as a phase or amplitude of the residual vibration, or the state of the nozzle Nz may be determined based on a combination of a plurality of parameters among a cycle, a phase, and amplitude of the residual vibration. In addition, a state of the nozzle Nz may be determined based on a variation in the cycle or a variation in the amplitude of the residual vibration. Moreover, occurrence of an ejection failure due to not only an increase in viscosity of the ink and mixing in of air bubbles but also adhesion of foreign matter (paper powder, dust) may be detected, for example, based on the residual vibration.

Fifth Modification Example

In the aforementioned embodiments, the residual vibration after a pressure change is generated in the ink in the pressure chamber 411 by driving the drive element 417 is detected as a change of electromotive force by mechanical displacement of the drive element 417 (piezoelectric element). That is, although the drive element 417 is used in the inspection of the head 41, the embodiments are not limited thereto. For example, a sensor for detecting vibration caused in the ink in the pressure chamber 411 by driving the drive element 417 may be provided in the printer 1 in addition to the drive element 417. For example, a sensor (example: pressure sensor) for detecting vibration (example: pressure change) generated in the ink in the pressure chamber 411 may be provided in the pressure chamber 411 or the ink supply port 413. In such a case, the sensor may detect not only the residual vibration after driving the drive element 417 but also vibration at the same time as driving the drive element 417 or vibration during and before driving the drive element 417, for example. In such a case, the nozzles may be caused to eject ink droplets based on a thermal scheme in which air bubbles are generated in the nozzles by using heat generating elements and the nozzles are caused to eject the ink due to the air bubbles.

Sixth Modification Example

FIG. 10 is a table showing a modification example of first drive and second drive. In the aforementioned embodiments, the inspection method 1 in FIG. 10 is performed so as to differentiate the pressure changes in the pressure chambers 411 corresponding to the nozzles next to the inspection target nozzle in the first drive and the second drive. That is, the head is inspected based on the detection signal (residual vibration) obtained in the first drive (single drive) in which the ejection waveform Wa is applied to the drive element 417 corresponding to the inspection target nozzle, the pressure chamber 411 is depressurized (expansion) and pressurized (contraction), and the pressure in the pressure chambers 411 corresponding to the adjacent nozzles are constantly maintained without applying the drive signal COM to the drive elements 417 and the detection signal obtained by the second drive (simultaneous drive) in which the ejection waveform Wa is applied to the drive elements 417 corresponding to the inspection target nozzle and the adjacent nozzles, and the pressure chamber 411 is depressurized and pressurized. In addition, the pressure chamber 411 may be depressurized and pressurized by the minute vibration waveform Wb.

However, the embodiments are not limited thereto, and the pressure chamber 411 corresponding to the inspection target nozzle may be depressurized and pressurized by the ejection waveform Wa and the pressure chambers 411 corresponding to the adjacent nozzles may be depressurized and pressurized by the minute vibration waveform Wb in the first drive, and the pressure chambers 411 corresponding to the inspection target nozzle and the adjacent nozzles may be depressurized and pressurized by the ejection waveform Wa in the second drive as shown as the inspection method 2 in FIG. 10, for example.

In addition, the pressure chamber 411 corresponding to the inspection target nozzle may be pressurized and pressure chambers 411 corresponding to the adjacent nozzles may be depressurized in the first drive, and the pressure chambers 411 corresponding to the inspection target nozzle and the adjacent nozzles may be pressurized in the second drive as shown as the inspection method 3, for example. In addition, the pressure chamber 411 is pressurized by applying the waveform part (the waveform part which raises potential from the standby potential Vs to the maximum potential Vh, for example) for pressurizing (contracting) the pressure chamber 411 to the drive element 417, and the pressure chamber 411 is depressurized by applying the waveform part (the waveform part which lowers potential from the standby potential Vs to the minimum potential Vl, for example) for depressurizing (expanding) the pressure chamber 411 to the drive element 417.

In addition, the pressure chamber 411 corresponding to the inspection target nozzle may be pressurized and the pressure in the pressure chambers 411 corresponding to the adjacent nozzles may be constantly maintained without any change in the first drive, and the pressure chambers 411 corresponding to the inspection target nozzle and the adjacent nozzles may be pressurized in the second drive as shown as the inspection method 4, for example. In addition, the pressure in the pressure chamber 411 is constantly maintained by not applying the drive signal COM to the drive element 417 or applying the waveform part which maintains the standby potential Vs to the drive element 417.

In addition, the pressure chamber 411 corresponding to the inspection target nozzle may be depressurized and pressurized by the ejection waveform Wa or the minute vibration waveform Wv and the pressure chambers 411 corresponding to the adjacent nozzles may be merely depressurized in the first drive while the pressure chambers 411 corresponding to the inspection target nozzle and the adjacent nozzles are depressurized and pressurized by the ejection waveform Wa or the minute vibration waveform Wb in the second drive as shown as the inspection method 5, for example. In addition, the pressure chamber 411 corresponding to the inspection target nozzle may be depressurized and the pressure chambers 411 corresponding to the adjacent nozzles may be pressurized in the first drive while the pressure chambers 411 corresponding to the inspection target nozzle and the adjacent nozzles are depressurized in the second drive as shown as the inspection method 6, for example.

If the pressure in the pressure chambers 411 of the adjacent nozzle changes in any way, the nozzle whose partition wall 415*a* of the pressure chamber has not peeled off is hardly influenced. Therefore, the detection signals (how the residual vibration occurs) obtained by driving the drive element are the same. On the other hand, if the pressure changes in the pressure chambers 411 of the adjacent nozzles are different from each other, the nozzle whose partition wall 415*a* of the pressure chamber has peeled off is affected by the pressure changes, and the detection signals (how the residual vibration occurs) become different. Thus, it is possible to inspect peeling-off of the partition wall 415*a* of the pressure chamber by differentiating the pressure changes in the pressure chambers 411 corresponding to the nozzles next to the inspection target nozzle in the first drive and the second drive as shown by the aforementioned inspection methods 1 to 6. That is, it is possible to determine that the inspection target nozzle is a nozzle whose partition wall 415*a* of the pressure chamber has peeled off when there is a difference between the first detection signal obtained by the first drive and the second detection signal obtained by the second drive, and that the inspection target nozzle is a nozzle whose partition wall 415*a* of the pressure chamber has not peeled off when there is no difference between the first detection signal and the second detection signal.

Other Embodiments

The above embodiments are described for the purpose of easy understanding of the invention and are not intended to limit the invention. It is needless to say that the embodiments can be modified and improved without departing from the gist of the invention, and the invention includes the equivalents thereof.

Although a printer which repeats the operation of the head moving in the moving direction and ejecting ink and the operation of transporting the medium in the transport direction is exemplified in the aforementioned embodiments, the embodiments are not limited thereto. For example, the embodiments may be applied to a printer in which a head ejects ink toward a medium when the medium passes in a direction perpendicular to the width direction below the fixed head with nozzles aligned in the width direction of the medium. In addition, the embodiments may be applied to a printer which repeats an operation of a head moving in an X direction and printing an image on a medium transported to a print area and an operation of the head moving in a Y direction to print an image, and thereafter, transports a part of the medium, on which an image has not yet been printed, to the print area.

Although an ink jet printer is exemplified as an example of the liquid ejecting apparatus in the aforementioned embodiments, the embodiments are not limited thereto. The same technology as those in the aforementioned embodiments may be applied to various liquid ejecting apparatuses which apply an ink jet technology, such as a color filter manufacturing apparatus, a dyeing apparatus, a microfabricated apparatus, a semiconductor manufacturing apparatus, a surface processing apparatus, a three-dimensional modeling apparatus, a gasification apparatus, an organic EL manufacturing apparatus (particularly, polymer EL manufacturing apparatus), a display manufacturing apparatus, a film forming apparatus, and a DNA chip manufacturing apparatus.

The entire disclosure of Japanese Patent Application No. 2012-105271, filed May 2, 2012 is expressly incorporated by reference herein.

What is claimed is:

1. A liquid ejecting apparatus comprising:

a head which is provided with a plurality of ejecting units including a first ejecting unit which includes a first nozzle for ejecting liquid, a first pressure chamber in communication with the first nozzle, and a first drive element provided at the first pressure chamber, and a second ejecting unit which includes a second nozzle for ejecting liquid, a second pressure chamber in communication with the second nozzle, and a second drive element provided at the second pressure chamber, wherein the first nozzle ejects liquid by applying a drive signal to the first drive element, and the second nozzle ejects liquid by applying the drive signal to the second drive element, and wherein a liquid ejection failure of the first nozzle is determined using a first detection signal obtained by applying a first drive signal to the first drive element and applying a second drive signal to the second drive element, and a second detection signal obtained by applying the first drive signal to the first drive element and not applying the second drive signal to the second drive element.

2. The liquid ejecting apparatus according to claim 1, wherein the first drive signal is one of a drive signal for causing the first nozzle to eject the liquid, a drive signal for causing minute vibration in liquid in the first pressure chamber without causing the first nozzle to eject the liquid, a drive signal for pressurizing the first pressure chamber, and a drive signal for depressurizing the first pressure chamber, wherein the second drive signal is one of a drive signal for causing the second nozzle to eject the liquid, a drive signal for causing minute vibration in the liquid in the second pressure chamber without causing the second nozzle to eject the liquid, a drive signal for pressurizing the second pressure chamber, a drive signal for depressurizing the second pressure chamber, and a drive signal for maintaining a pressure in the second pressure chamber to be constant.

3. The liquid ejecting apparatus according to claim 1, wherein the second nozzle is one or more nozzles disposed on both sides of the first nozzle.

4. The liquid ejecting apparatus according to claim 1, wherein cleaning processing for recovering from the liquid ejection failure of the first nozzle is performed based on the first detection signal and the second detection signal.

5. The liquid ejecting apparatus according to claim 1 wherein the liquid ejection failure of the first nozzle occurs when a viscosity of the liquid increases.

6. The liquid ejection apparatus according to claim 1 wherein the liquid ejection failure of the first nozzle occurs when a wall that partitions the first pressure chamber and the second pressure chamber peels-off.

7. The liquid ejecting apparatus according to claim 1 wherein the liquid ejection failure of the first nozzle occurs when air bubbles enter the first nozzle and the first pressure chamber.

8. A liquid ejecting method of a head which is provided with a plurality of ejecting units including a first ejecting unit which includes a first nozzle for ejecting liquid, a first pressure chamber in communication with the first nozzle, and a first drive element provided at the first pressure chamber, and a second ejecting unit which includes a second nozzle for ejecting liquid, a second pressure chamber in communication with the second nozzle, and a second drive element provided at the second pressure chamber, the method comprising:

causing the first nozzle to eject liquid by applying a drive signal to the first drive element;

causing the second nozzle to eject liquid by applying the drive signal to the second drive element; and determining a liquid ejection failure of the first nozzle by using a first detection signal obtained by applying a first drive signal to the first drive element and applying a second drive signal to the second drive element, and a second detection signal obtained by applying the first drive signal to the first drive element and not applying the second drive signal to the second drive element.

* * * * *